US011682852B2

(12) United States Patent
Little

(10) Patent No.: US 11,682,852 B2
(45) Date of Patent: Jun. 20, 2023

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Terrance F. Little, Fullerton, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 259 days.

(21) Appl. No.: 17/212,180

(22) Filed: Mar. 25, 2021

(65) Prior Publication Data

US 2021/0313721 A1 Oct. 7, 2021

Related U.S. Application Data

(60) Provisional application No. 63/041,921, filed on Jun. 21, 2020, provisional application No. 63/004,068, filed on Apr. 2, 2020.

(51) Int. Cl.

| | |
|---|---|
| ***H01R 13/648*** | (2006.01) |
| ***H01R 12/71*** | (2011.01) |
| ***H01R 13/6585*** | (2011.01) |
| ***H01R 13/6471*** | (2011.01) |
| ***H01R 4/02*** | (2006.01) |
| ***H01R 13/627*** | (2006.01) |

(52) U.S. Cl.

CPC ..... *H01R 12/71* (2013.01); *H01R 4/023* (2013.01); *H01R 13/6272* (2013.01); *H01R 13/6471* (2013.01); *H01R 13/6585* (2013.01)

(58) Field of Classification Search

CPC ..... H01R 12/71; H01R 12/712; H01R 4/023; H01R 4/024; H01R 13/6272; H01R 13/6471; H01R 13/6585

USPC ..... 439/607.09

See application file for complete search history.

(56) References Cited

U.S. PATENT DOCUMENTS

| | | | | |
|---|---|---|---|---|
| 7,114,963 | B2 | 10/2006 | Shuey et al. | |
| 8,764,464 | B2 | 7/2014 | Buck et al. | |
| 10,122,129 | B2 | 11/2018 | Milbrand, Jr. et al. | |
| 11,211,743 | B2 * | 12/2021 | Briant | H01R 13/6591 |
| 11,489,293 | B2 * | 11/2022 | Balakrishnan | H01R 12/721 |
| 2020/0358227 | A1 | 11/2020 | Henry et al. | |

* cited by examiner

*Primary Examiner* — Khiem M Nguyen

(74) *Attorney, Agent, or Firm* — Ming Chieh Chang

(57) ABSTRACT

A plug connector adapted for connecting corresponding wires includes an insulative body integrally formed with two rows of plug contacts in a lateral direction and a transverse bar. The plug contacts are categorized with differential-pair contacts and grounding contacts alternately arranged with each other in a longitudinal direction. The transverse bar extends along the longitudinal direction perpendicular to the lateral direction and is unitarily linked to rear ends of all the grounding contacts of each row of plug contacts while being isolated from the differential-pair contacts. All the contacts and the transverse bar are stamped from a same sheet metal initially, and the differential-pair contacts are successively disconnected from the transverse bar after the plug contacts are integrally formed with the insulative body.

20 Claims, 46 Drawing Sheets

230

200

ELECTRICAL CONNECTOR ASSEMBLY

CROSS REFERENCE TO RELATED APPLICATIONS

This application claims the benefit of, and priority to, U.S. Provisional Patent Application No. 63/004,068, filed Apr. 2, 2020, and Provisional Patent Application No. 63/041,921, filed Jun. 21, 2020, the contents of which are incorporated entirely herein by reference.

BACKGROUND OF THE INVENTION

1. Field of the Invention

The present invention relates generally to an electrical connector assembly, and particularly to the electrical connector having grounding contacts and signal contacts.

2. Description of Related Arts

The electrical connector includes a plug connector linked with the wires, and a receptacle connector mounted upon the printed circuit board wherein the plug connector uses a paddle card for connecting to the receptacle connector and linked with the wires. Notably, using the paddle card inevitably increases the length/height of the plug connector.

Hence, an electrical card connector with lower profile configuration is desired.

SUMMARY OF THE INVENTION

A plug connector adapted for connecting corresponding wires comprises an insulative body with at least one row of plug contacts and a transverse bar. Each row of the plug contacts being categorized with differential-pair contacts and grounding contacts alternately arranged with each other in a longitudinal direction. The transverse bar extends along the longitudinal direction and unitarily linked to rear ends of all the grounding contacts of each row of plug contacts while being isolated from the differential-pair contacts. All the contacts of each row of plug contacts and the transverse bar are stamped from a same sheet metal initially, and the differential-pair contacts are successively disconnected from the transverse bar after the plug contacts are integrally formed with the insulative body.

A receptacle connector for mounting to a printed circuit board comprises a housing comprising a pair of longitudinal walls extending along a longitudinal direction and a pair of short wall connecting with the longitudinal wall and equipped with corresponding passageways in the longitudinal wall, and defining a mating slot formed between the pair of longitudinal walls in the lateral direction, and two rows of receptacle contacts extending into both the respective passageways and the mating slot. The mating slot includes a slot between a portion of the longitudinal walls having the passageways, two guiding holes at opposite ends of the slot in the longitudinal direction between a portion of the longitudinal walls having no passageways thereon and a cavity recessed from the mating surface of each longitudinal wall and communicating with guiding holes and the slot.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
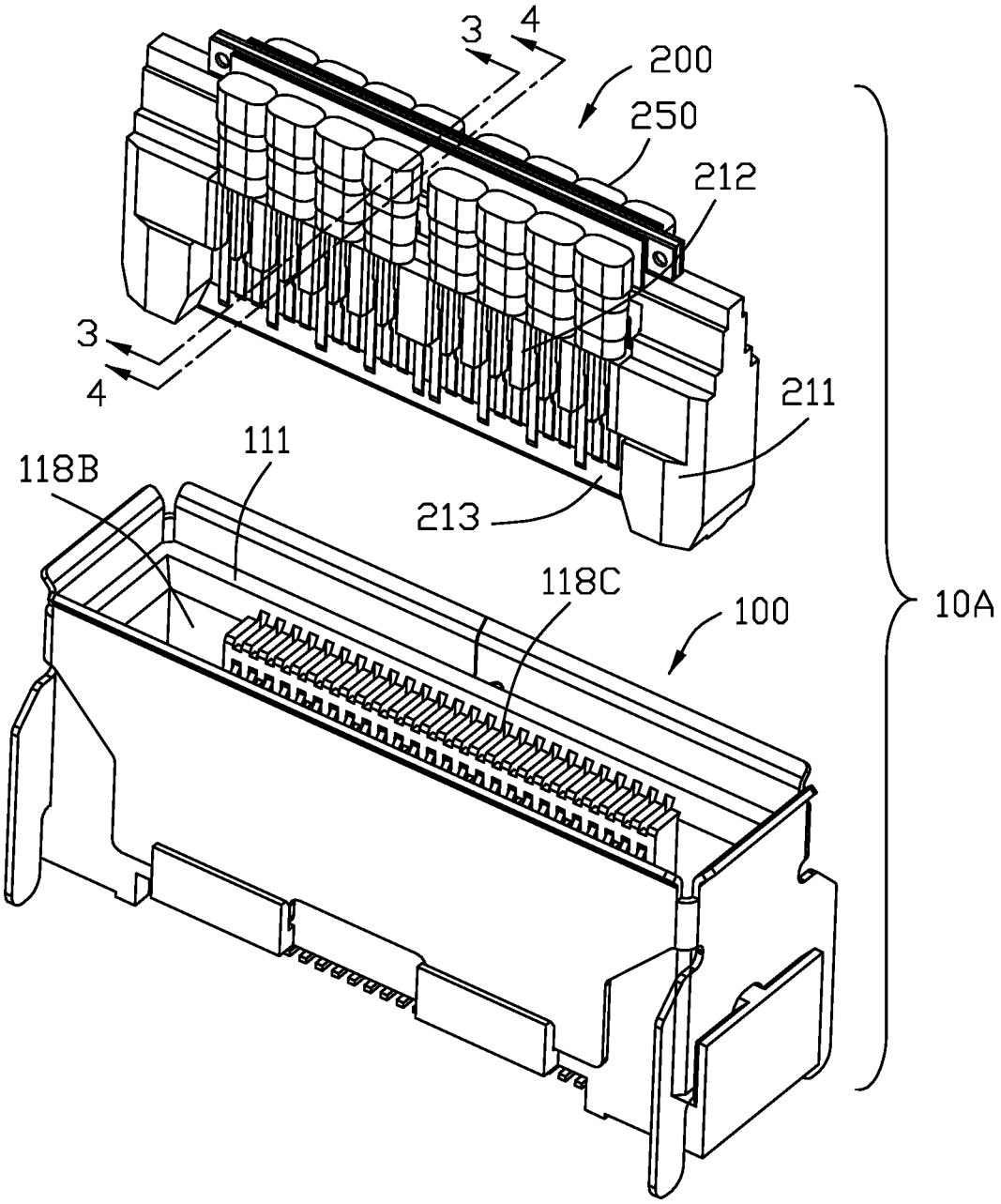
FIG. 1 is a perspective view of the electrical connector assembly including a receptacle connector and a plug connector according to a first embodiment of the present invention wherein the plug connector is removed away from the receptacle connector.
Figure 2:
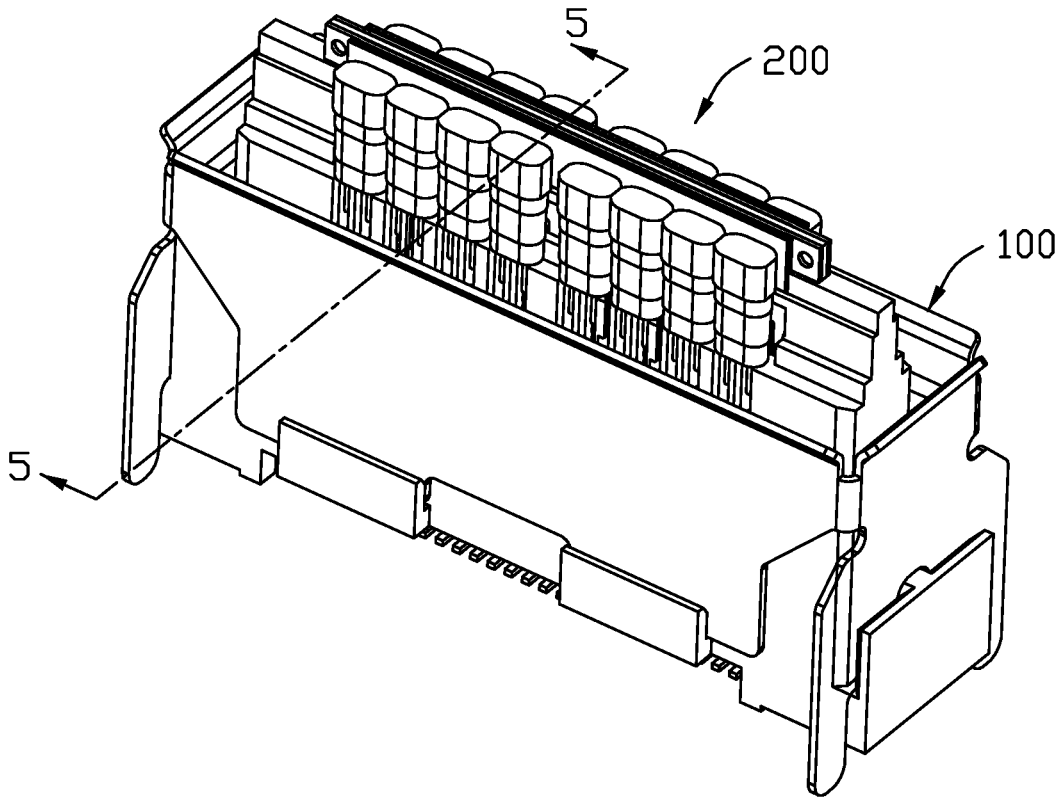
FIG. 2 is a perspective view of the electrical connector assembly of FIG. 1 wherein the plug connector is mate within the receptacle connector.
Figure 3:
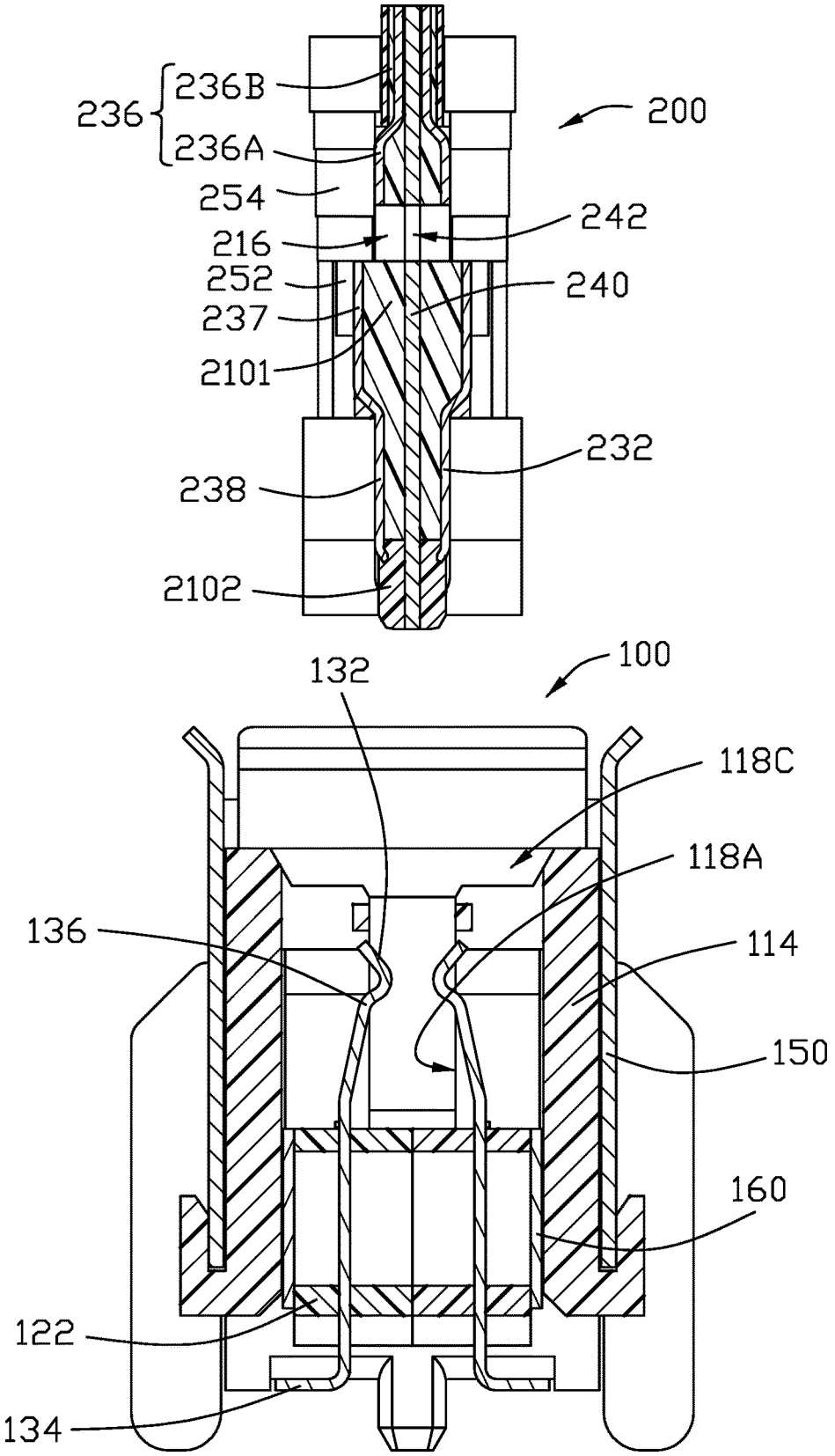
FIG. 3 is a cross-sectional view of the electrical connector assembly along the differential pair contacts taken along broken lines 3-3 in FIG. 1.
Figure 4:
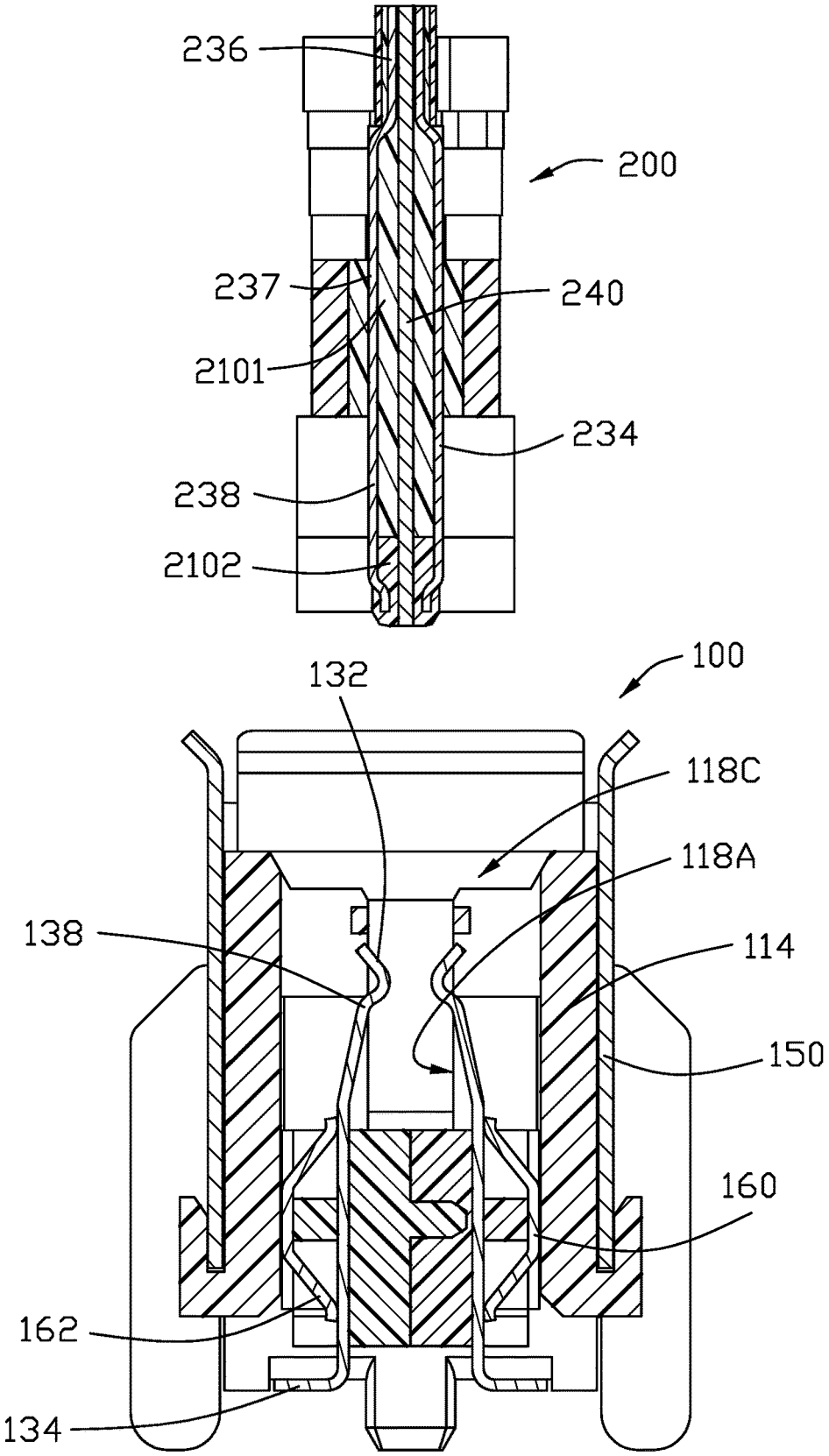
FIG. 4 is another cross-sectional view of the electrical connector assembly of FIG. 1 along the grounding contacts taken along line 4-4 in FIG. 1.
Figure 5:
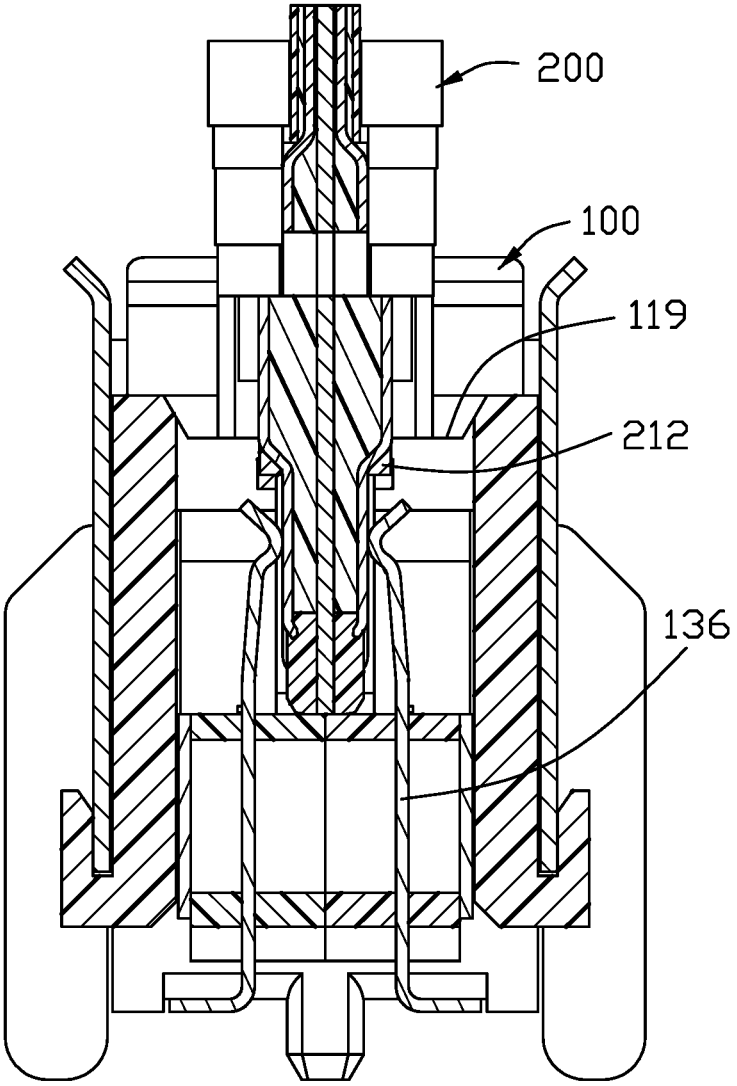
FIG. 5 is a cross-sectional view of electrical connector assembly taken along line 5-5 in FIG. 2.
Figure 6:
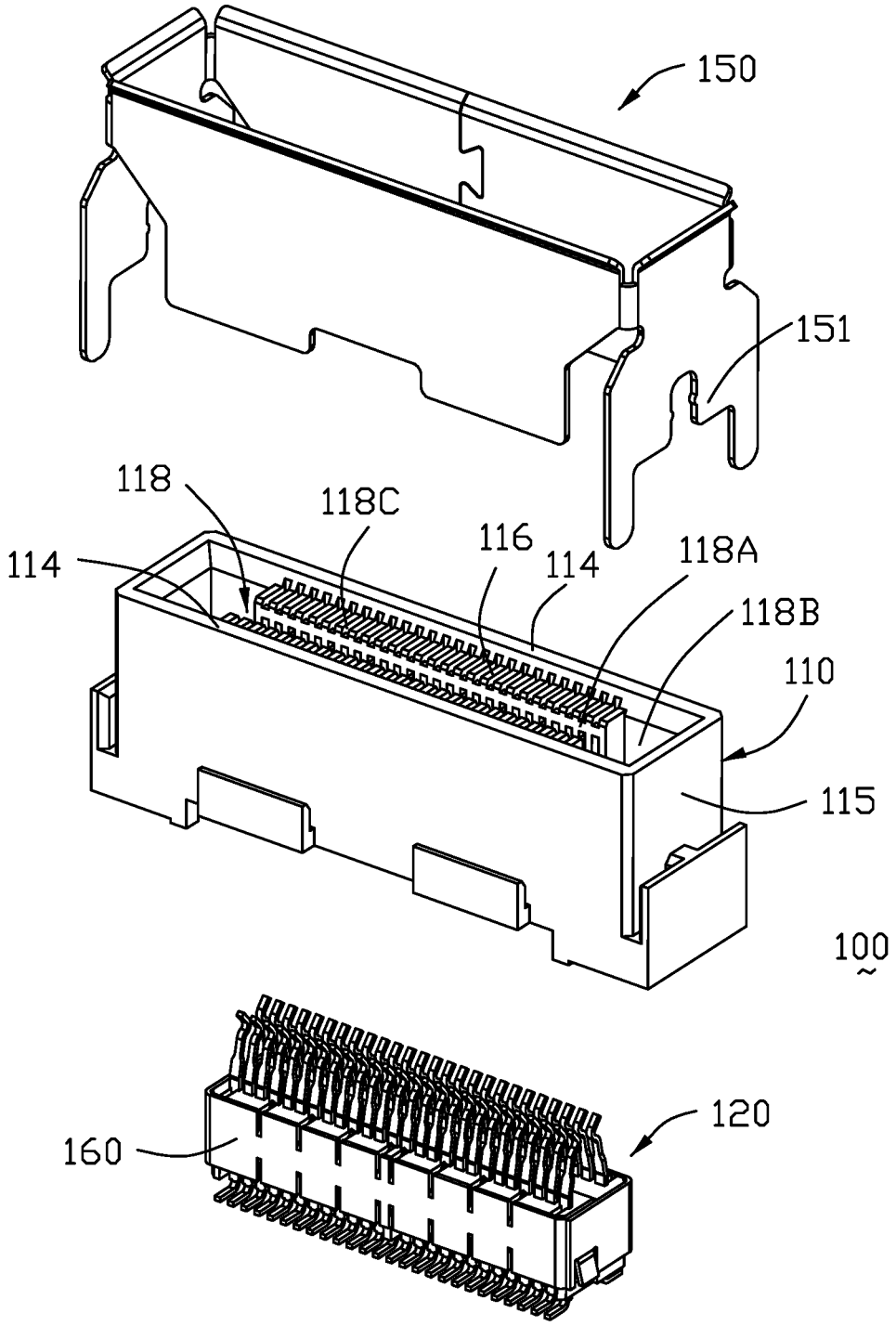
FIG. 6 is an exploded perspective view of the receptacle connector of the electrical connector assembly of FIG. 1.
Figure 7:
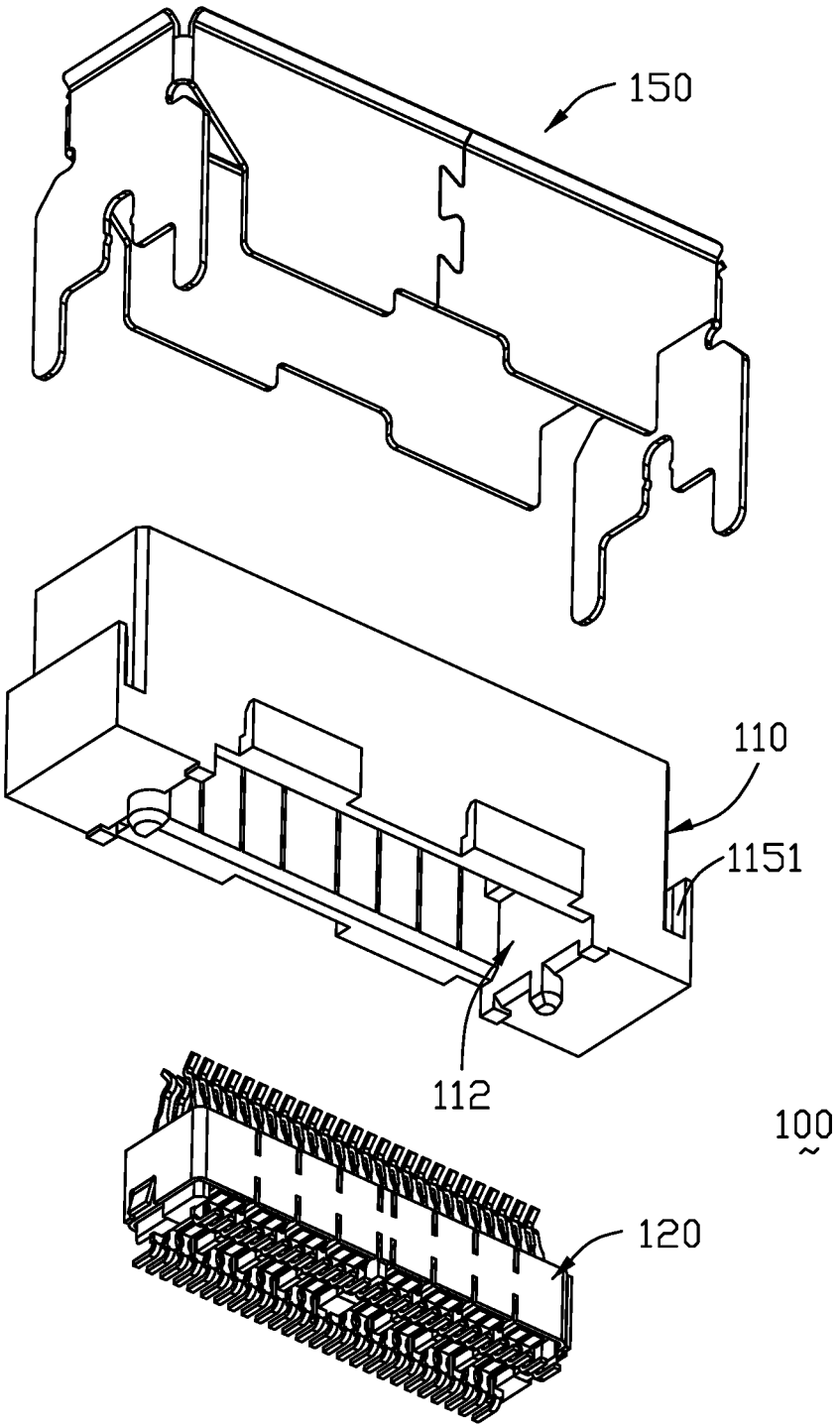
FIG. 7 is another exploded perspective view of the receptacle connector of the electrical connector assembly of FIG. 6.
Figure 8:
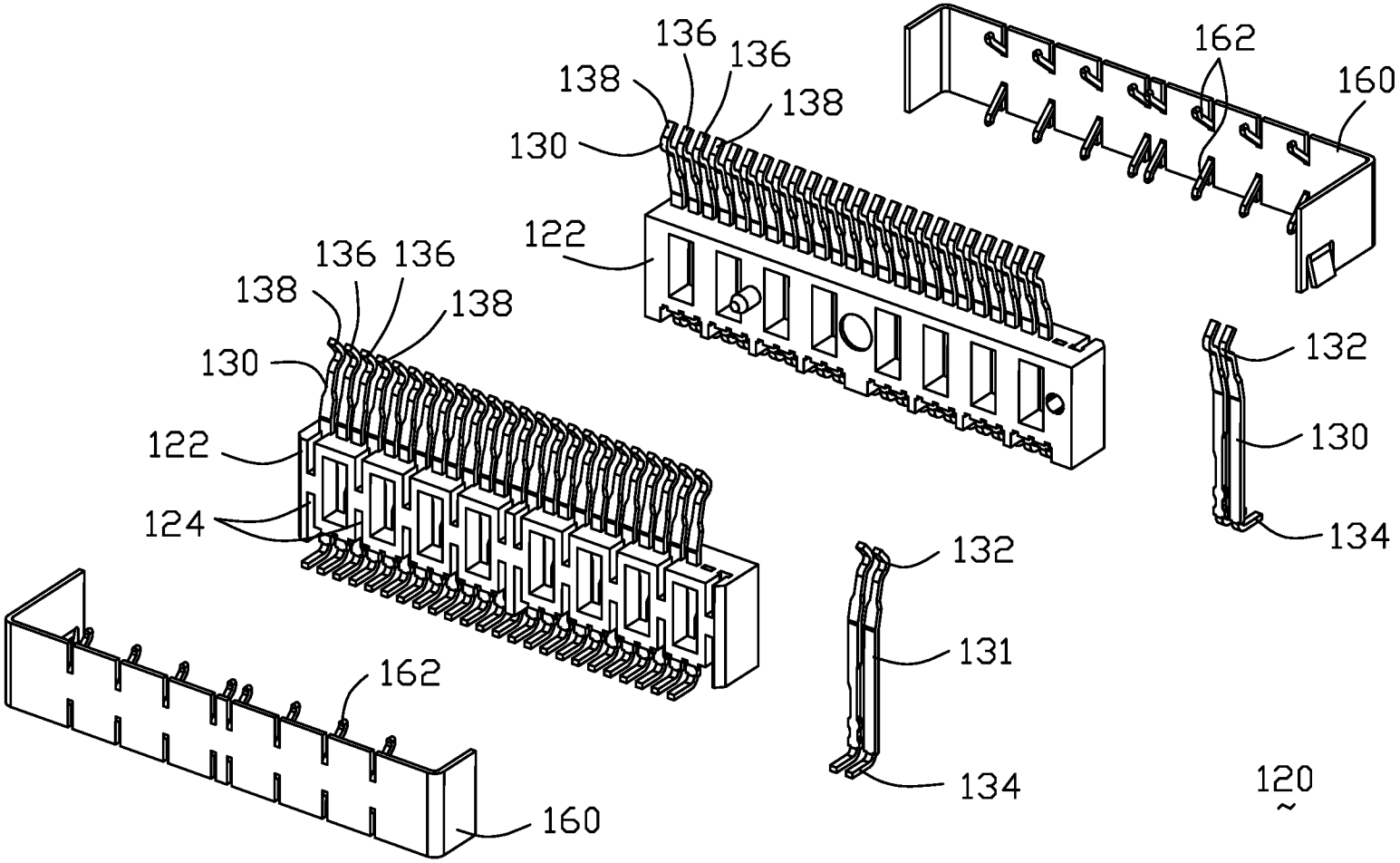
FIG. 8 is a further exploded perspective view of the receptacle connector of the electrical connector assembly of FIG. 6.
Figure 9:
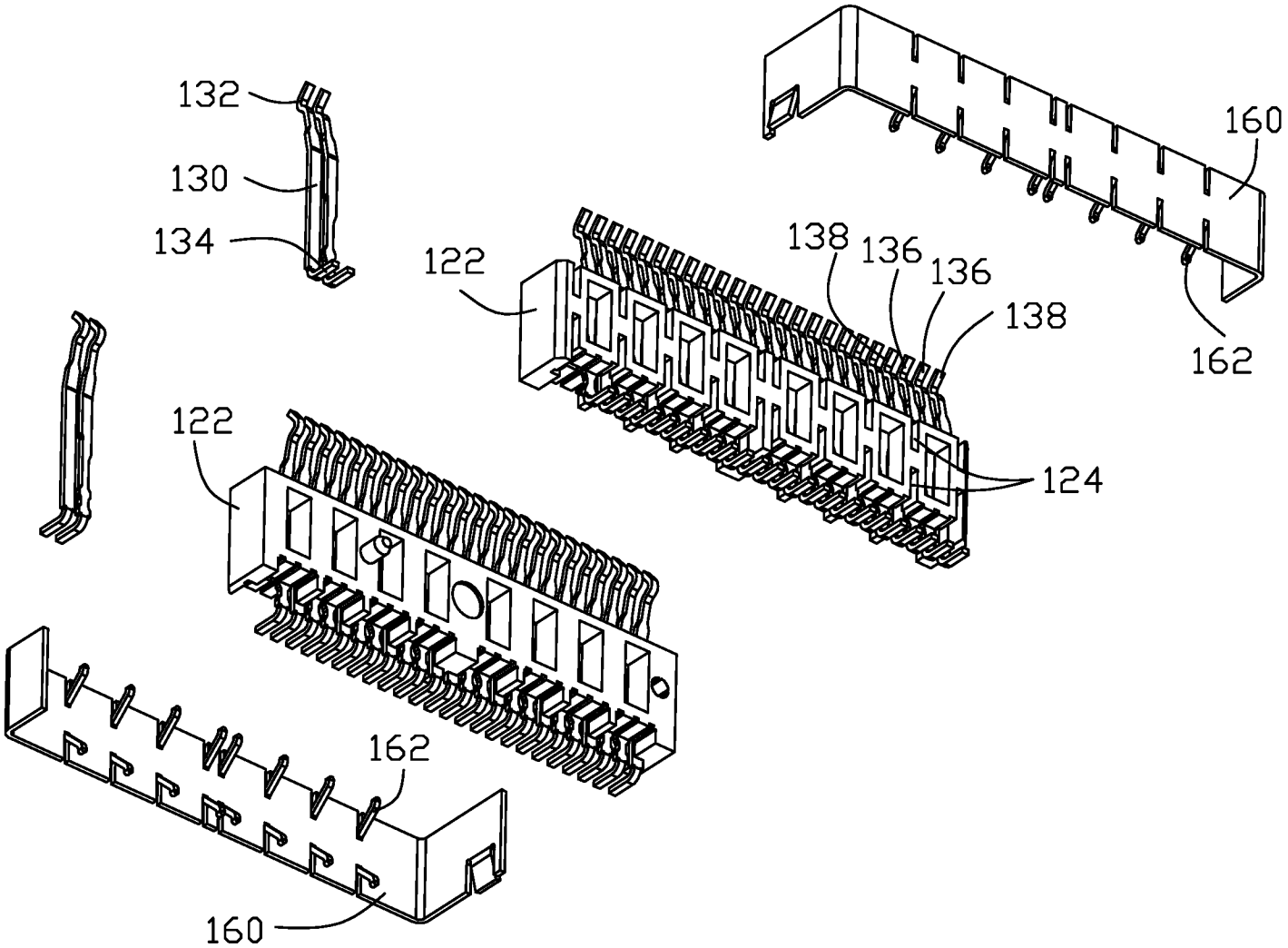
FIG. 9 is another exploded perspective view of the receptacle connector of the electrical connector assembly of FIG. 8.
Figure 10:
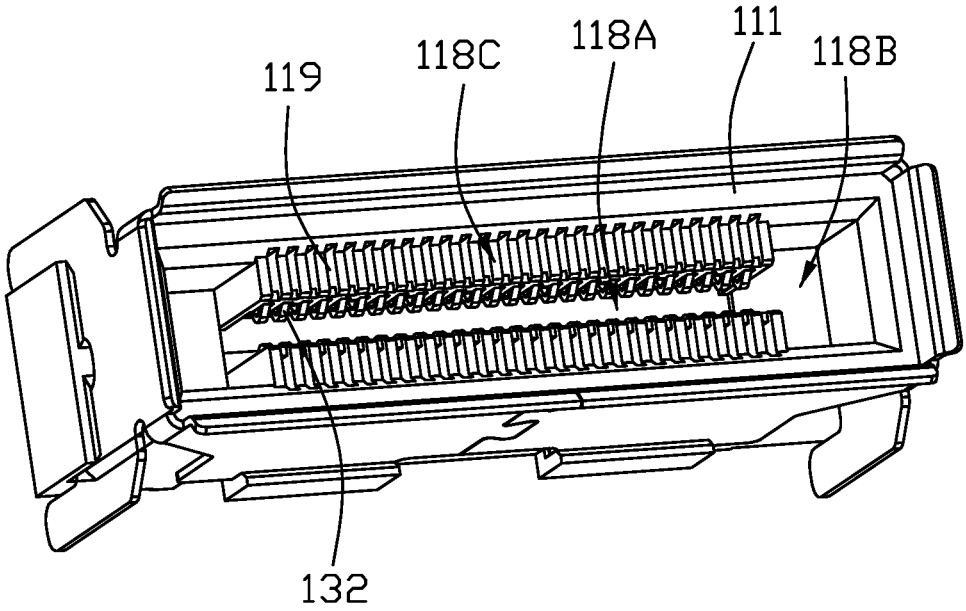
FIG. 10 is a perspective view of the receptacle connector of the electrical connector assembly of FIG. 1.

As shown in FIGS. 1-16 illustrating a first embodiment of this invention, an electrical connector assembly 10A includes a receptacle connector 100 which is mounted upon the printed circuit board (PCB, not shown), and a plug connector 200 adapted to be mated with each other in a mating direction, i.e., in this embodiment, the mating direction is in a vertical direction to the PCB. The receptacle connector 100 is a vertical type of board connector which is vertically mounted on the PCB and defines a mating face 111 opposite to the PCB, the plug connector 200 connecting with wires 250 is inserted with the receptacle connector through the mating face 111 in the vertical direction.

As best shown in FIGS. 6 through 10, the receptacle connector 100 includes an insulative housing 110 defining a receiving space 112 at a lower end therein in the vertical direction, a contact module 120 received within the receiving space 112, and a metallic shield 150 or an outer shell attached upon exterior surfaces of the insulative housing 110. The insulative housing 110 includes a pair of longitudinal walls 114 extending along a longitudinal direction perpendicular to the vertical direction and forming a plurality of passageways 116 therein, and a pair of short wall 115 jointing with the longitudinal walls 114. A mating slot 118 opening upwards, is formed between the pair of longitudinal walls 114 and the pair of short walls 115, which is recessed from the mating face 111 of the housing 110.

The contact module 120 includes a pair of insulators 122 face to face stacked with each other in the lateral direction perpendicular to both the vertical direction and the longitudinal direction. A plurality of receptacle contacts 130 are integrally formed with each insulator 122 via insert-molding. Each contact 130 includes a deflectable contacting section 132 extending in the corresponding passageway 116 and further into the mating slot 118 in the lateral direction, and a soldering section 134 for mounting to the aforementioned printed circuit board (not shown) on which the receptacle connector 100 is mounted, and an upright section 131 jointing with the contacting section 132 and the soldering section 116. The contacts 130 are categorized with the differential-pair contacts 136 and the grounding contacts 138 alternately arranged with each other in the longitudinal direction. The insulator 122 forms a plurality of slots 124 aligned with the corresponding grounding contacts 138 in the lateral direction to expose such grounding contacts 138 in the lateral direction.

A pair of metallic shells 160 or inner shell encloses the pair of insulators 122 and is composed of two halves each forming a plurality of spring tangs 162 extending into the slots 124 to mechanically and electrically connect the corresponding grounding contacts 138, respectively. In this embodiment, each grounding contact 138 is touched with two spring tangs 162, one spring tang 162 extend upwards and the other spring tang 162 extends downwards. The pair of insulators 122 embedded with the receptacle contacts 130 and enclosed with the inner shell 160 is inserted the receiving space 112.

The outer shell 150 includes four walls attached the outer sides of the insulative housing 110, the insulative housing defines a saddle slot 1151 at each short walls 115 and the opposite walls of the outer shell 150 defines corresponding shape portion 151 retained in the saddle slot 1151. Please notes, the front edge of the outer shell 150 is higher than the mating face 111 of housing to guide the insertion of the plug connector 200.

As best shown in FIGS. 11 through 16, the plug connector 200 includes an insulative body 210 enclosing two rows of plug contacts 230 with a metallic shielding/grounding plate 240 therebetween in the lateral direction via insert-molding. In detail, the shielding plate 240 is firstly insert-molded within a first insulator 2101 as labeled in FIGS. 3 and 4 via the first-shot insertion-molding to form a sub-assembly, and two rows of plug contacts 230 are positioned upon the sub-assembly and further over-molded with a second insulator 2102 via the second-shot insert-molding to secure the plug contacts 230 thereto to form the final plug connector 200.

Figure 11:
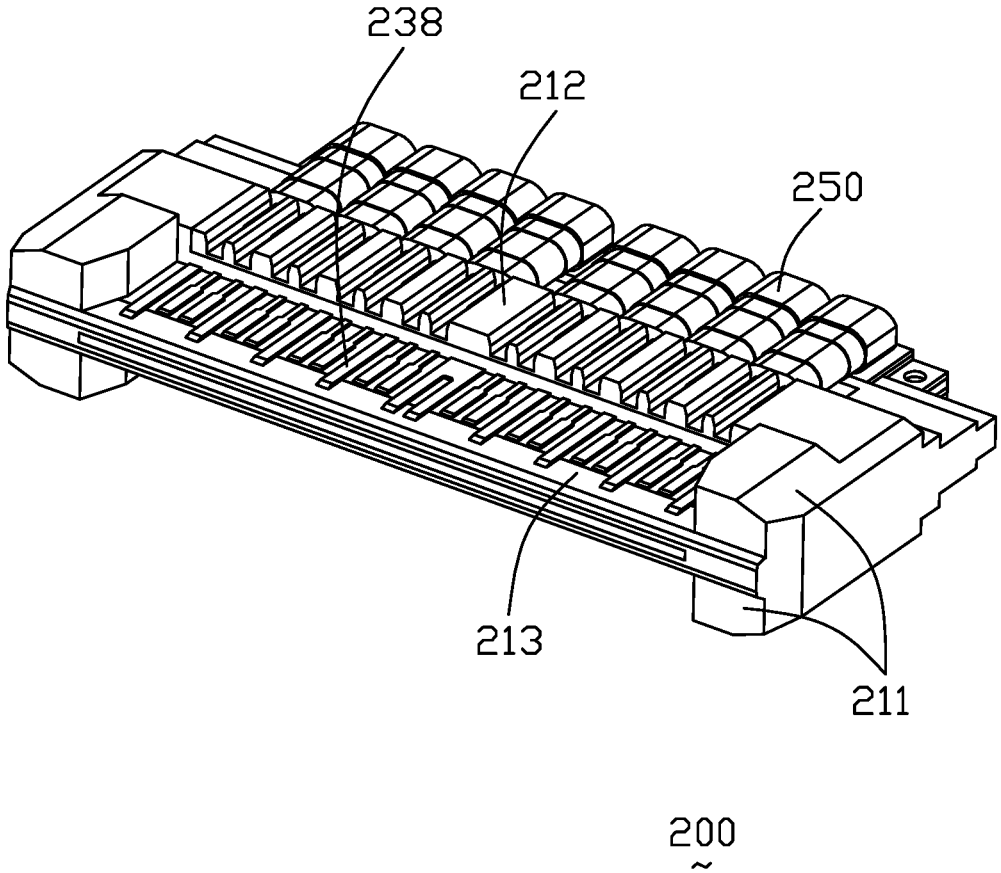
FIG. 11 is a perspective view of the plug connector of the electrical connector assembly of FIG. 1 wherein the wires are only shown with front portions thereof.
Figure 12:
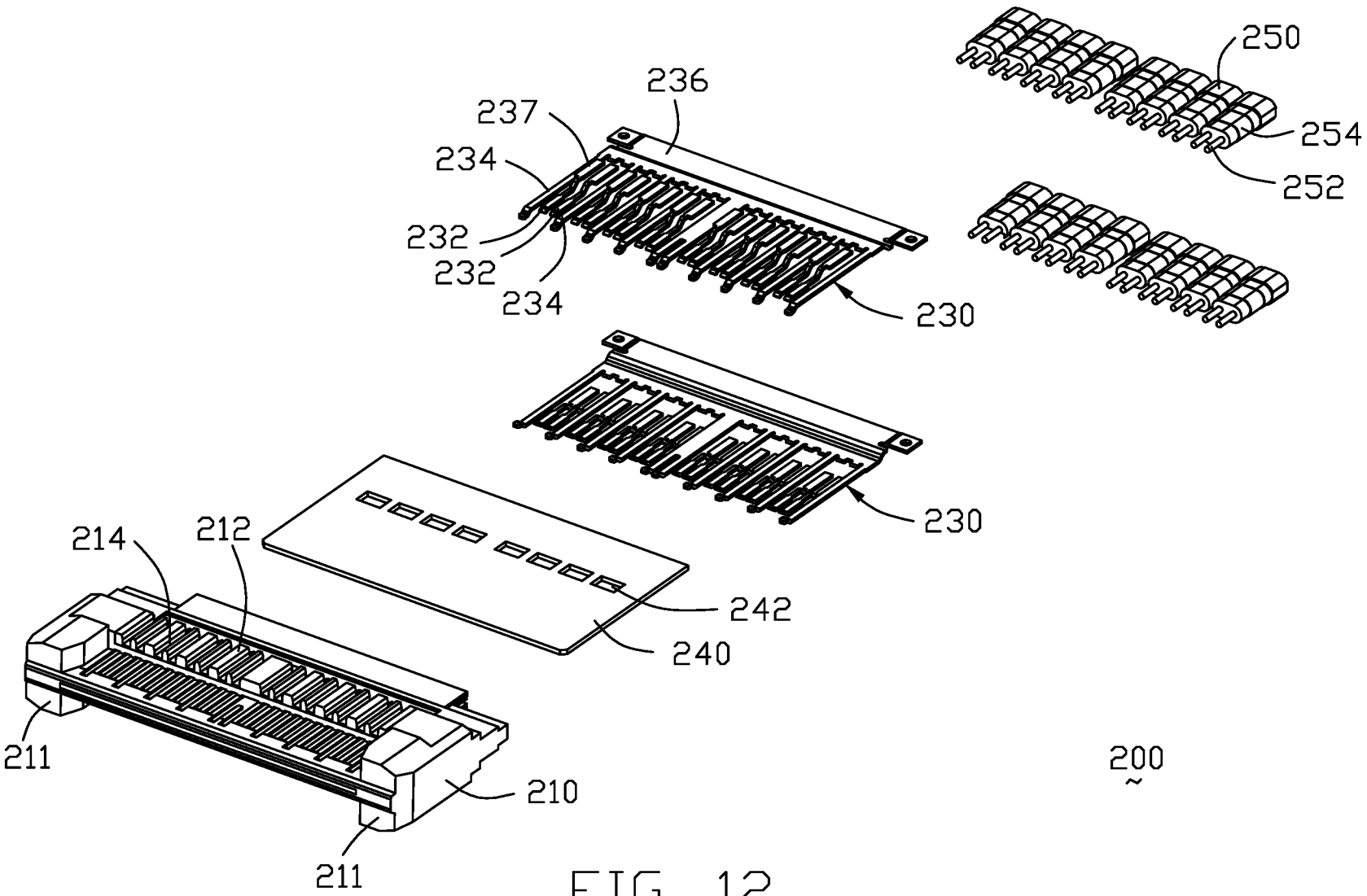
FIG. 12 is an exploded perspective view of the plug connector of the electrical connector assembly of FIG. 11.
Figure 13:
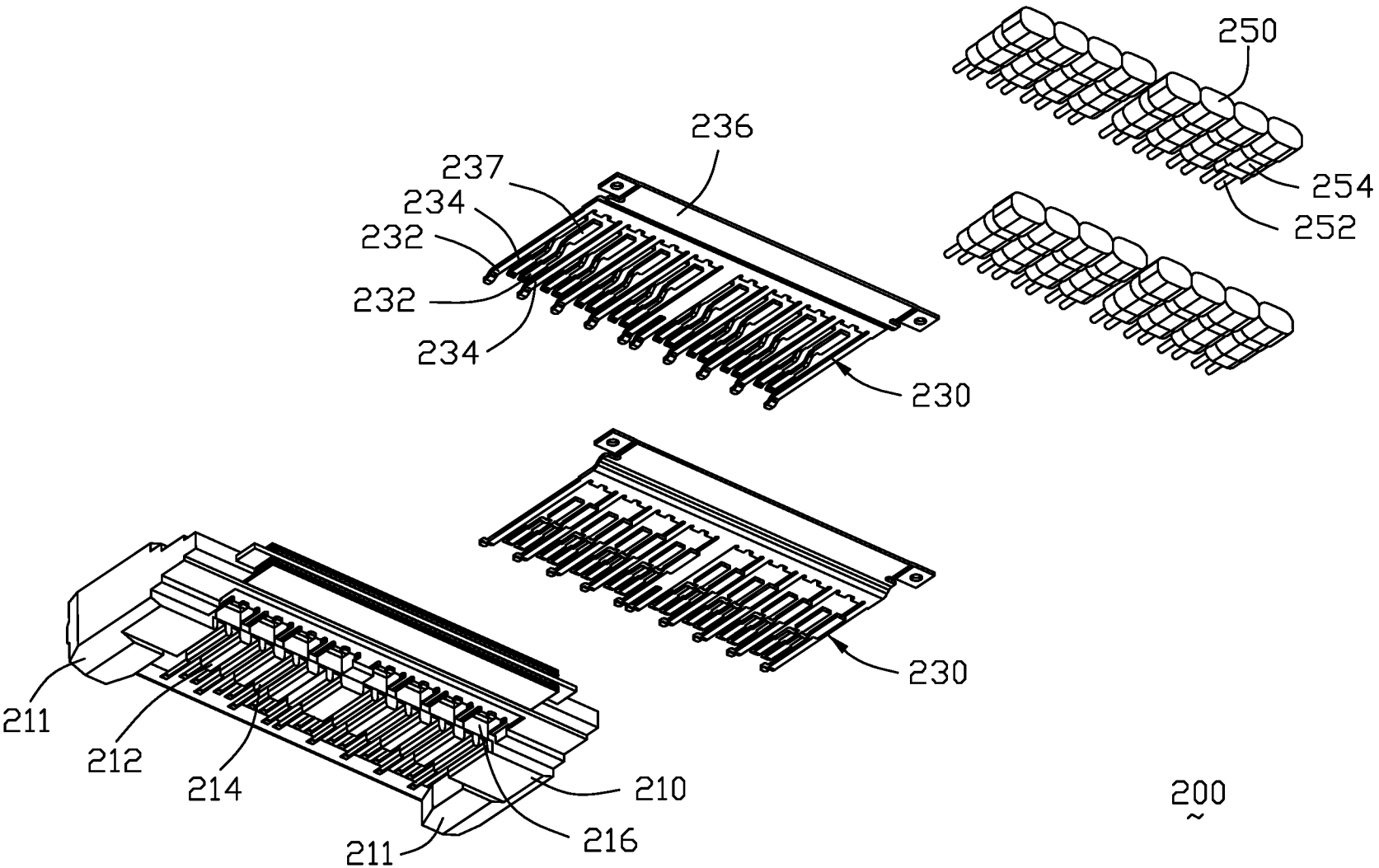
FIG. 13 is another exploded perspective view of the plug connector of the electrical connector assembly of FIG. 12.
Figure 14:
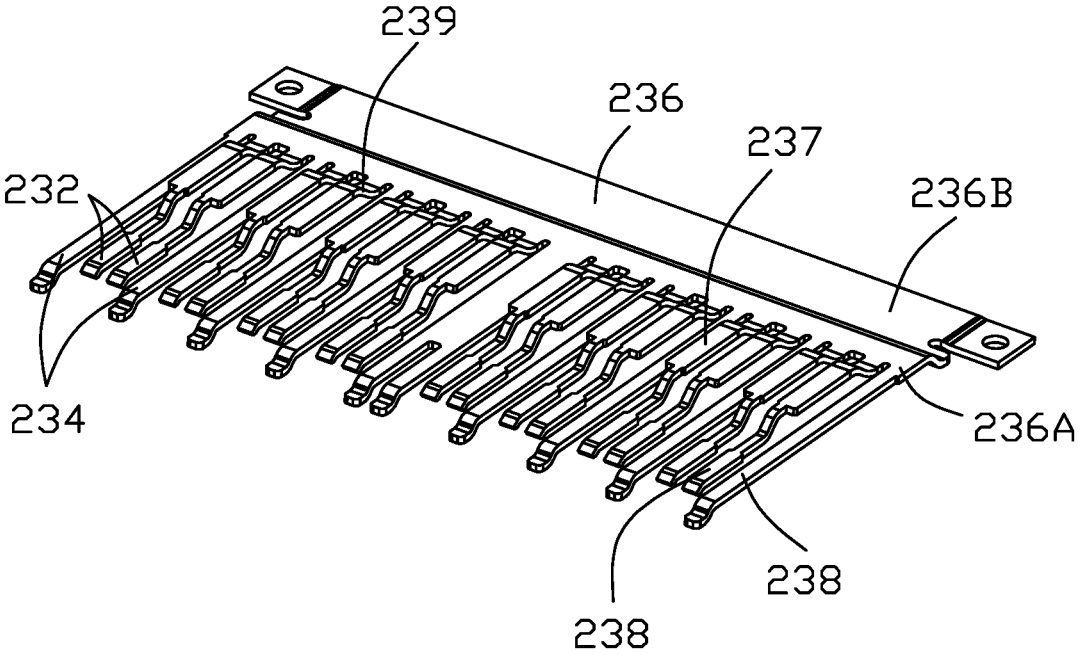
FIG. 14 is a perspective view of one row of contacts of the plug connector of the electrical connector assembly wherein the differential-pair contacts are originally linked with the transverse bar.

The plug contacts 230 include the differential-pair contacts 232 and the grounding contacts 234 alternately arranged with each other in the longitudinal direction. All the plug contacts 230 in each row are stamped from a same sheet metal so as to be commonly linked to a transverse bar 236 extending in the longitudinal direction, as shown in FIG. 14. Each contact 230 is essentially stationary and includes a mating section 238 exposed upon the mating face of the insulative body 210. The differential-pair contacts 232 further have the corresponding connecting/tail sections 237, which are raised/offset in the lateral direction and separated from the transverse bar 236 in the vertical direction via further stamping, for connecting to the corresponding wires 250 illustrated later, while the grounding contacts 234 remain to be linked with the transverse bar 236, as shown in FIGS. 12-13. As shown in FIGS. 11-12, the insulative body 210 forms a pair of platforms 212 with a plurality of grooves 214 to expose the connecting/tail sections 237 and receive the inner conductors 252 of the corresponding wires 250 for soldering therebetween. Each transverse bar 236 includes an outer/front part 236A and an inner/rear part 236B as labeled in FIG. 14, viewed along the lateral direction and the vertical direction, wherein the inner part 236B is mechanically and electrically connected to the shielding plate 240 in the lateral direction. Each wire 250 further includes a copper shielding/braiding 254 to mechanically and electrically connect to the outer part 236A.

Figure 15:
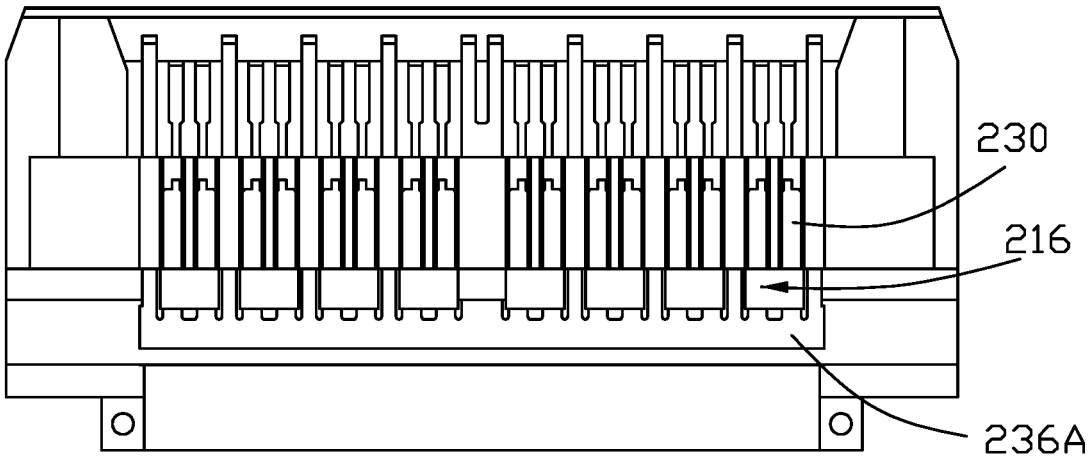
FIG. 15 is an elevational top view of the plug connector of the electrical connector assembly of FIG. 11 to show the differential-pair contacts are separated from the transverse bar thereof.
Figure 16:
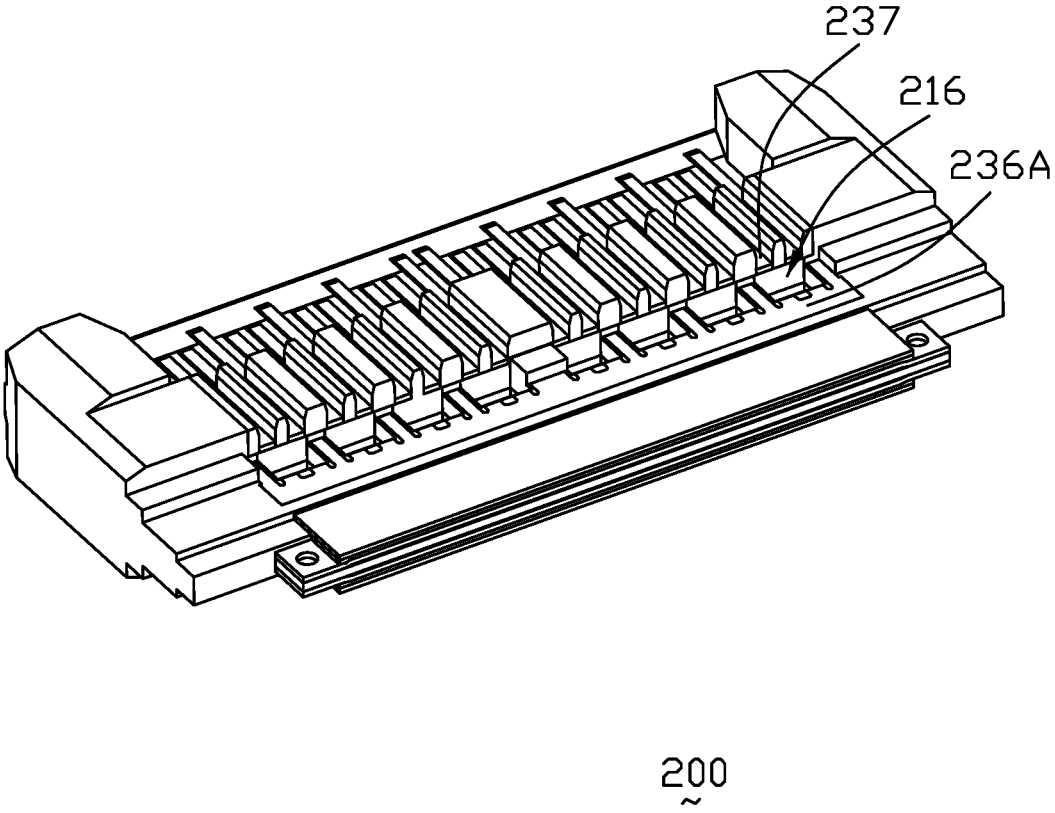
FIG. 16 is a perspective view of the plug connector of the electrical connector assembly of FIG. 10 wherein the wires are removed therefrom.

Notably, the insulative body 210 forms a plurality of openings 216 to respectively expose the linking sections 239 of the differential-pair contacts 232 as shown in FIGS. 15-16, which are originally connected between the transverse bar 236 and the connecting/tail sections 237, so as to allow a tool to remove the linking sections 239 of the differential-pair contacts 232 after the contacts 230 are integrally formed with the insulative body 210 via the second-shot insert-molding in order to separate the differential-pair contacts 232 from the transverse bar 236. Notably, the shielding plate 240 also requisitely forms a plurality of through holes 242 in alignment with the corresponding openings 216 for removing the linking sections 237 in the lateral direction for facilitating removal of the linking sections 239.

The insulative body 210 defines a front tongue 213 in front of the platforms 212, upon which the mating sections 238 of the plug contacts expose. The insulative body 210 further forms a pair of guiding posts 211 at two opposite ends of the front tongue 213 in the longitudinal direction. Each guiding post 211 is disposed at opposite sides of the front tongue 213. In this embodiment, the front end of the grounding contact 234 abuts against the shielding plate 240 for electrical connection optimally. Understandably, in this embodiment the plug connector 200 is made via the first-shot and the second shot insert-molding. Anyhow, a single-shot insert-molding for integrally forming both two rows of plug contacts 230 and the shielding plate 240 is also feasible. Notably, the corresponding drawings may not show the detailed structures of the insulative body 210 while the skilled person may well know how to implement the single-shot or the double-shot insert-molding process during making the plug connector, including the additional bridge structures between the neighboring contacts or the additional/secondary carrier at the front ends of the contacts.

As best shown in FIGS. 1-5 and 10, the insulative housing 110 of the receptacle connector 100 further defines two guiding holes 118B, each guiding hole 118B has larger dimension in the lateral direction than the slot 118A between the longitudinal walls 114, that means two opposite ends of the longitudinal walls 114 without any contacts are dig in to form said guiding holes. Moreover, upper edges of the longitudinal walls 114 are dig in, remaining a cavity 118C. The guiding holes 118B, the slot 118A, the cavity 118C is commonly defined as said mating slot 118. The inner portion of the longitudinal wall 114 has lower top face or step surface 119 below the mating face 111. The step face 119 or cavity 118C is located between the mating face 111 and the contacting sections 132.

During mating, the plug connector 200 is inserted into the mating slot 118. The differential-pair contacts 136 and the grounding contacts 138 of the receptacle contacts 130 are mated with the corresponding differential-pair contacts 232 and the grounding contacts 234 of the plug contacts 230, respectively. As understandingly, the front tongue 213 is inserted into the slot 118A, the guiding posts 211 are inserted into the guiding holes 118B, and further the front end of the platform 212 is received in the cavity 118C.

Referring to FIGS. 17-33 illustrating a second embodiment which has improvement on the first embodiment of the connector assembly 10A, an electrical connector assembly 10B includes a plug connector 300 and a receptacle connector 400 mateable with each other in a horizontal direction. The receptacle connector 400 is a right-angle type of board connector, which has a mating direction parallel to the PCB (not shown).

As shown in FIGS. 23-28, the plug connector 300 includes a plug contact module 310 retained in an outer shell 380 and connected with a plurality of wires 390. The plug contact module 310 includes a pair of plug contact units 320 commonly sandwiching a metallic shielding plate 350 therebetween. Each plug contact unit 320 includes a plurality of plug contacts 330 integrally formed within an insulator 322 via insert-molding. The contacts 330 include a plurality of differential pairs 332 and grounding contacts 334 alternated with each other along the transverse direction. The manufacturing method of the plug contact unit 320 is similar to the first embodiment wherein both the differential pairs and the grounding contacts are originally commonly unitarily formed on a same contact carrier strip, i.e., the transverse bar 336, wherein the rear tail/soldering sections 331 of the differential pairs 332 are offset with regard to the front contacting section 333 so as to be located in a raised platform 323 of the insulator 322 for soldering with the corresponding wires. After the plug contacts 330 have been insert-molded within the insulator 322, the rear end regions of the differential pairs 332 are separated from the transverse bar 336 via punching through the corresponding openings 324 in the insulator 322. The shielding plate 350 also forms a plurality of holes 352 in alignment with the corresponding openings 324 of the insulator 322. In other words, such punching operation may be made after the both the plug contact units 320 are assembled with each other with the shielding plate 350 therebetween.

The insulator 322 includes a front low region 321 on which the plate front contacting sections 333 are exposed, and a rear raised platform 323 in which a plurality of grooves 325 are formed to receive the rear soldering sections 331 of the differential pairs 332 for connecting to the corresponding wires 390, respectively. Each insulator 322 further includes a pair of mounting posts 327, and the transverse bar 337 forms a pair of holes 338 receiving the pair of mounting posts 327.

Figure 28:
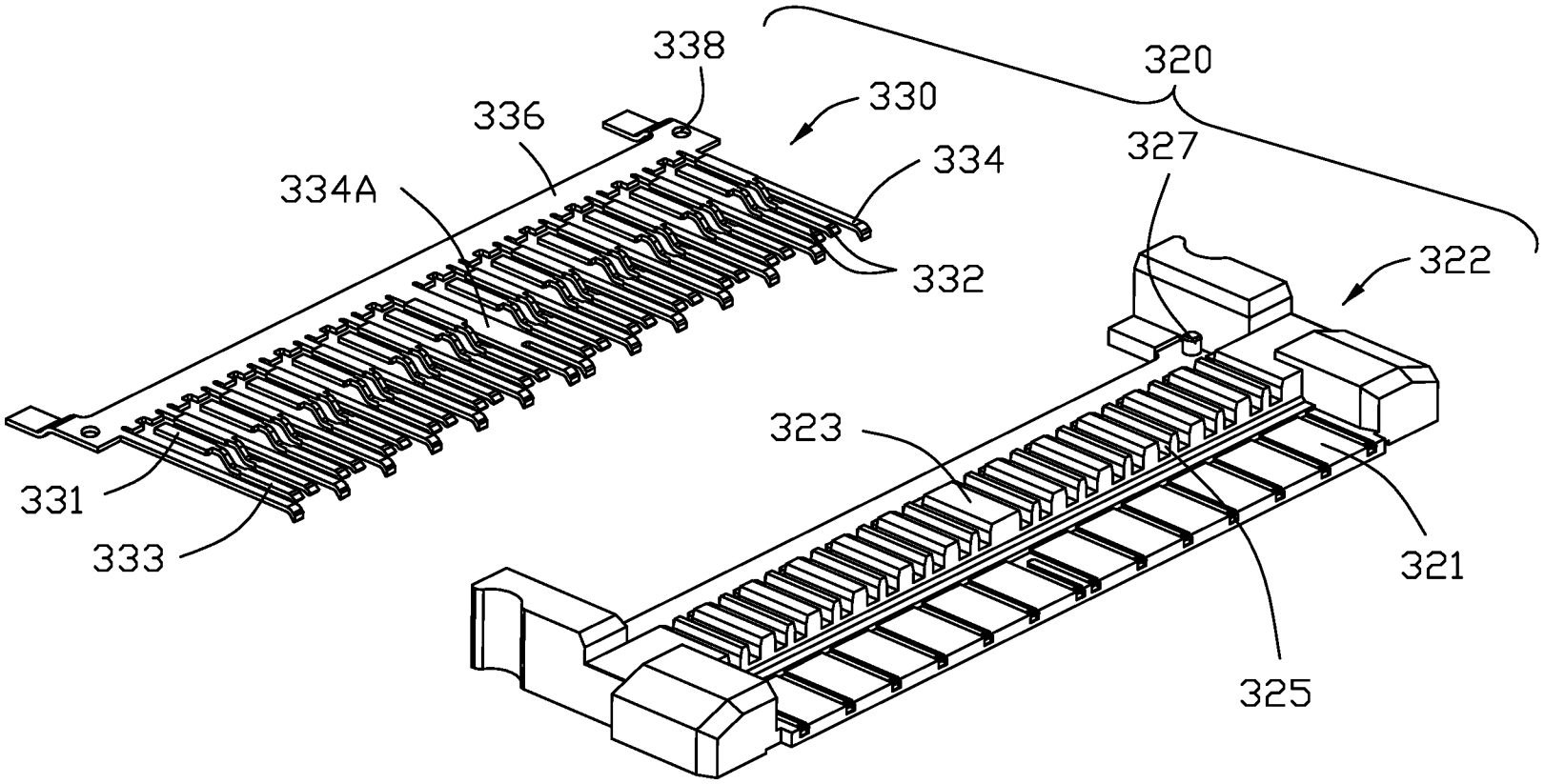
FIG. 28 is a perspective view of one plug contact unit of the plug contact module of the plug connector of the electrical connector assembly of FIG. 27.

Each wire 390 includes a pair of inner conductors 392 respectively soldered to the soldering sections 331 of the corresponding differential pair 332, and an outer copper shield 394. One insulator 322 forms a plurality of posts 326 to be assembled within the corresponding holes 328 of the other insulator 222. A pair of grounding bars 360 are mounted upon the corresponding insulator 322 by the mounting posts 327 extending through the pair of the holes 362 in the grounding bars 360. A plurality of openings 364 are formed in the grounding bar 360 with the corresponding retaining plates 366 stamped/bent therefrom. The outer copper shield 394 is sandwiched between the corresponding grounding bar 360 and the corresponding transverse bar 337. The solder material may be applied to a jointing region between the copper shield 394 and the transverse bar 336 via the opening 364 wherein the retaining plate 366 may be secured to the copper shield 394 via such solder material. The insulator 322 forms a rear space 329 to allow the extending wires 390 to pass. Correspondingly, the shielding plate 350 forms a corresponding rear space 354 to all the extending wires 390 to pass. It is noted that as shown in FIG. 28 the middle grounding contact 334A is widened with a fork contacting section to form a dual ground, thus allowing for optional Tx an Rx signal separation on the same side.

The outer shell 380 is composed of a pair of fasteners 382 assembled with each other to retain the plug contact module 310 in the outer shell 380. One of the fasteners 382 is equipped with a metallic resilient latch 388 having a hook 386 thereon. The outer shell 380 defines a pair of retaining slot 3821 at one fastener 382, the resilient latch 388 includes two retaining portions 3881 retained in the retaining slot 3821, a connecting portion 3822 bending rearward from a front edge of the retaining portion 3881 and a resilient portion 3883 extending forwards from connecting portion. A pair of hook 386 is disposed on the resilient portion 3883

Figure 17:
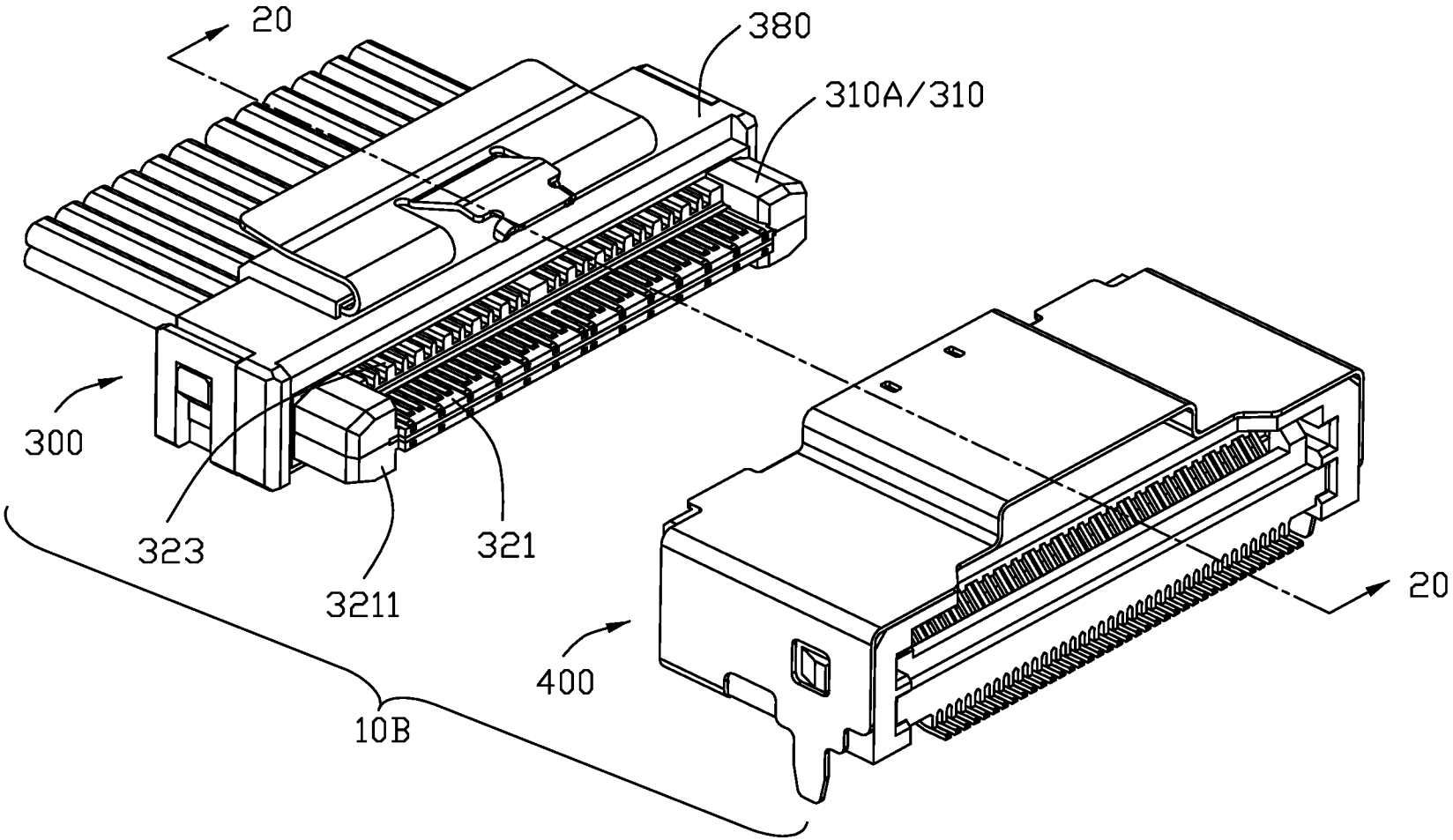
FIG. 17 is a perspective view of an electrical connector assembly including a plug connector and a receptacle connector according to the second embodiment of the invention, wherein the plug connector and the receptacle connector are separated from each other.
Figure 18:
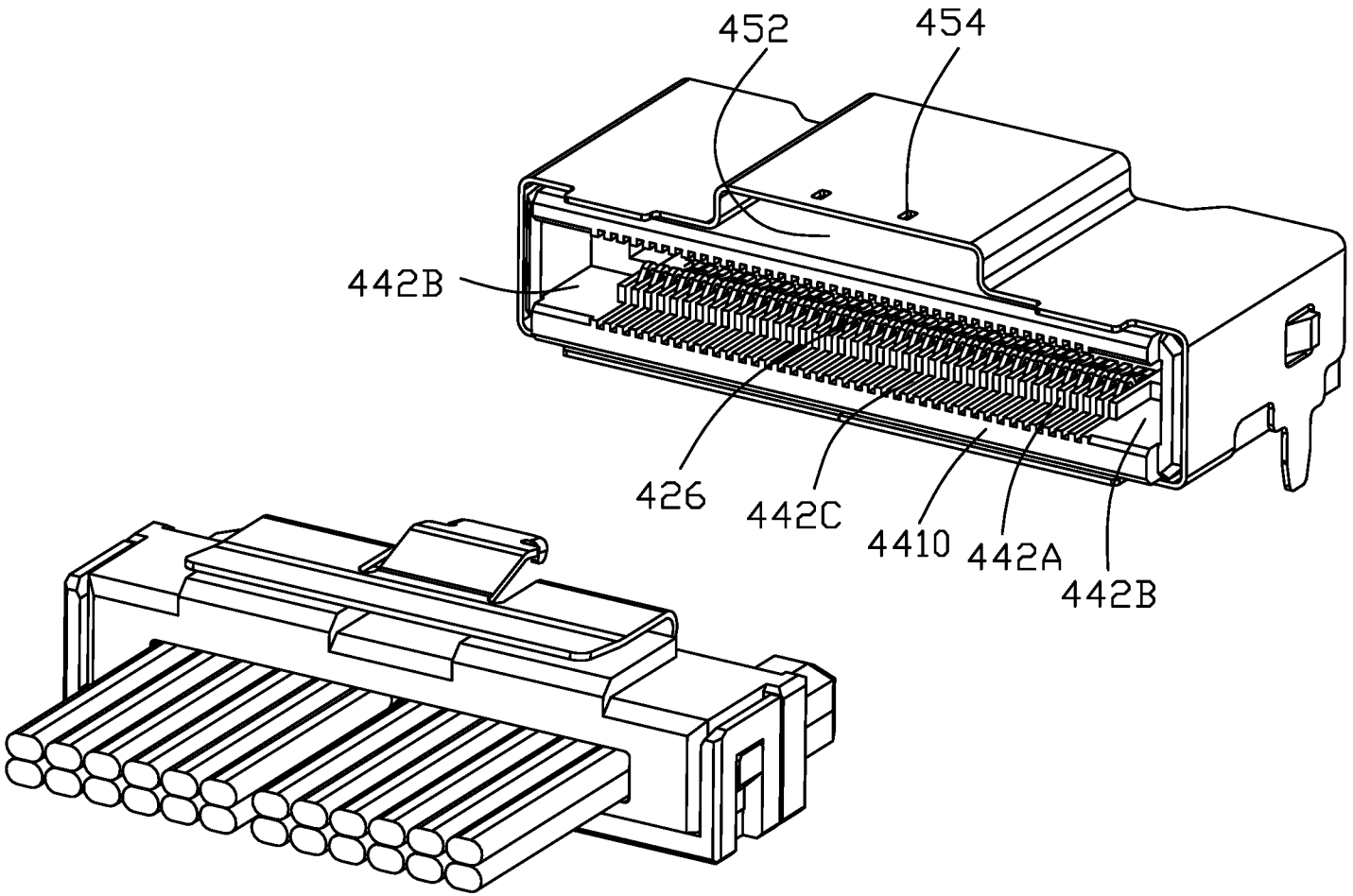
FIG. 18 is another perspective view of the electrical connector assembly of FIG. 17.
Figure 19:
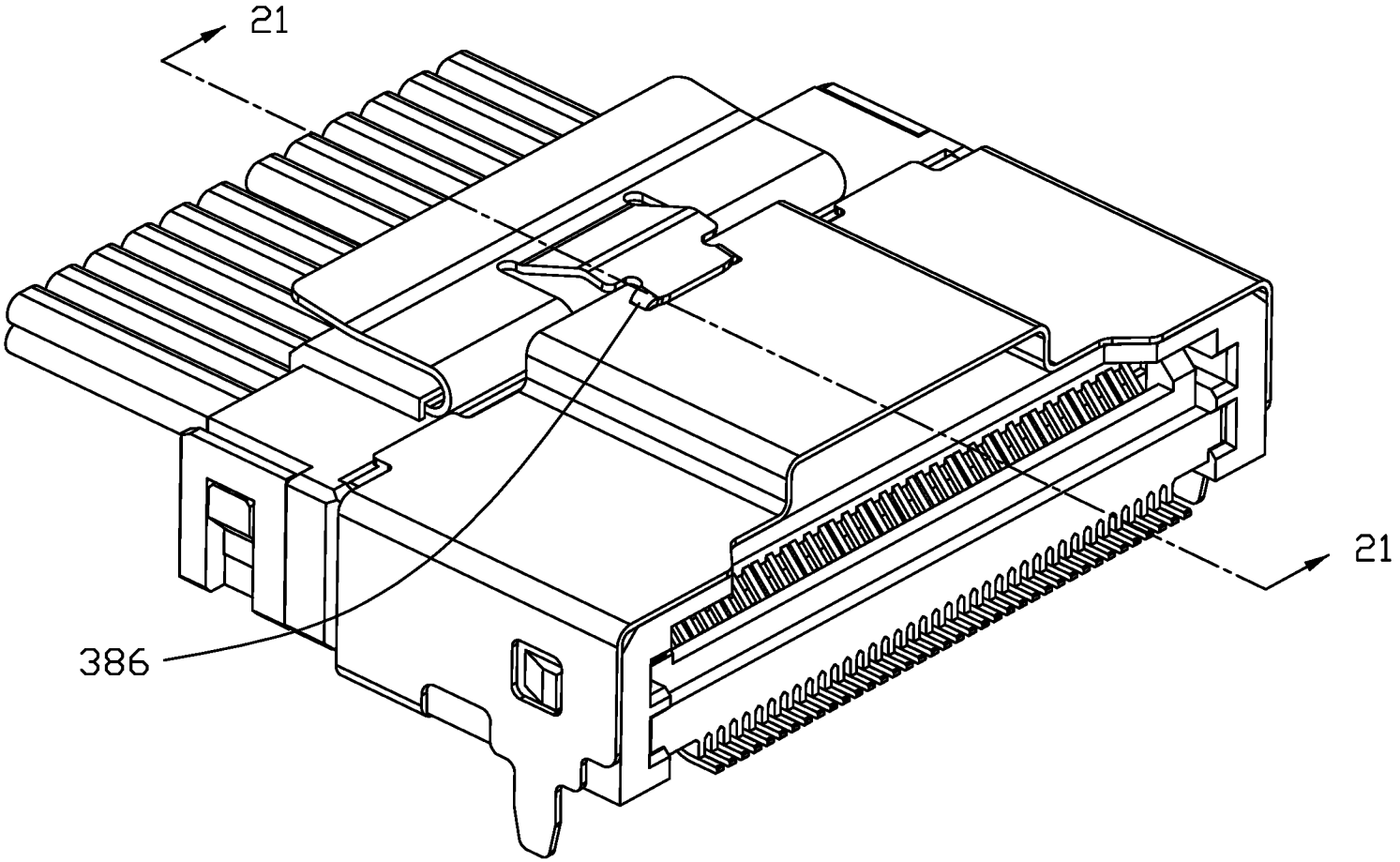
FIG. 19 is a perspective view of the electrical connector assembly of FIG. 1 wherein the plug connector and the receptacle connector are mated with each other.
Figure 20:
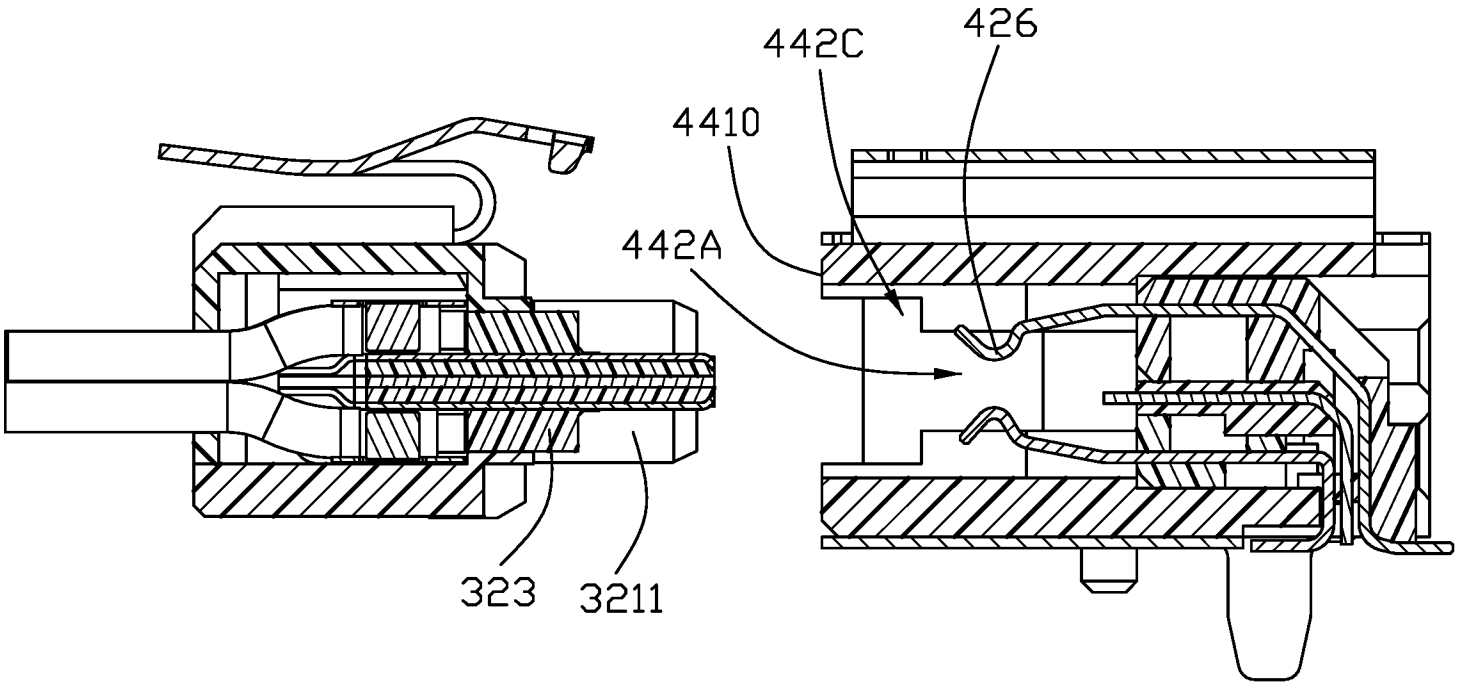
FIG. 20 is a cross-sectional view of electrical connector assembly taken along line 20-20 in FIG. 17.
Figure 21:
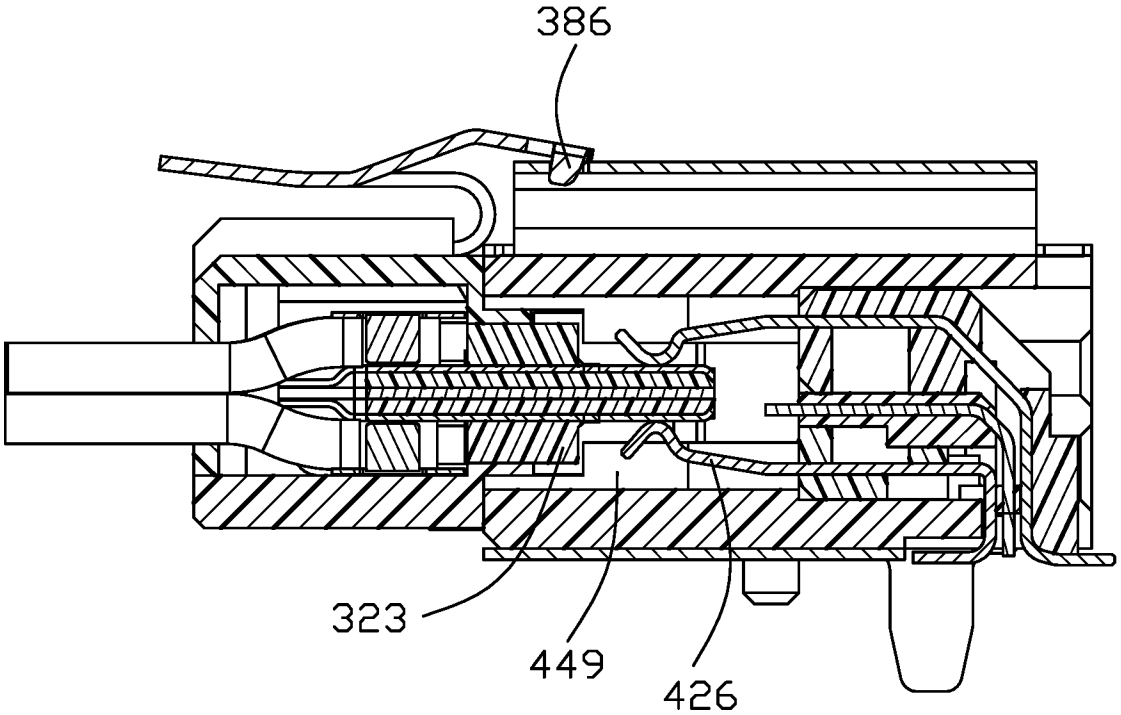
FIG. 21 is a cross-sectional view of electrical connector assembly taken along broken lines 21-21 in FIG. 19.
Figure 22:
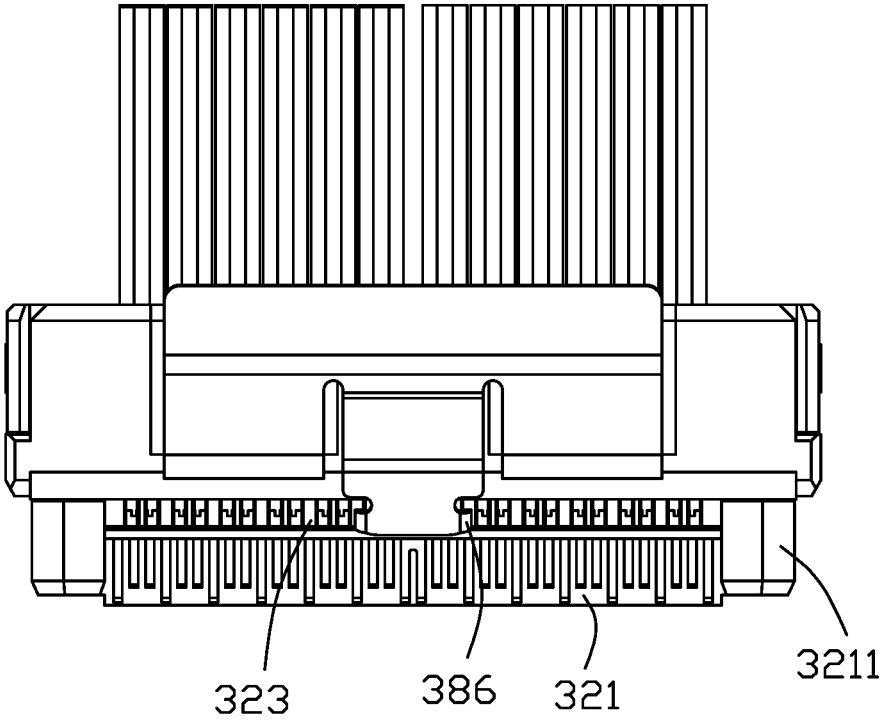
FIG. 22 is a top view of the plug connector of the electrical connector assembly of FIG. 17.
Figure 23:
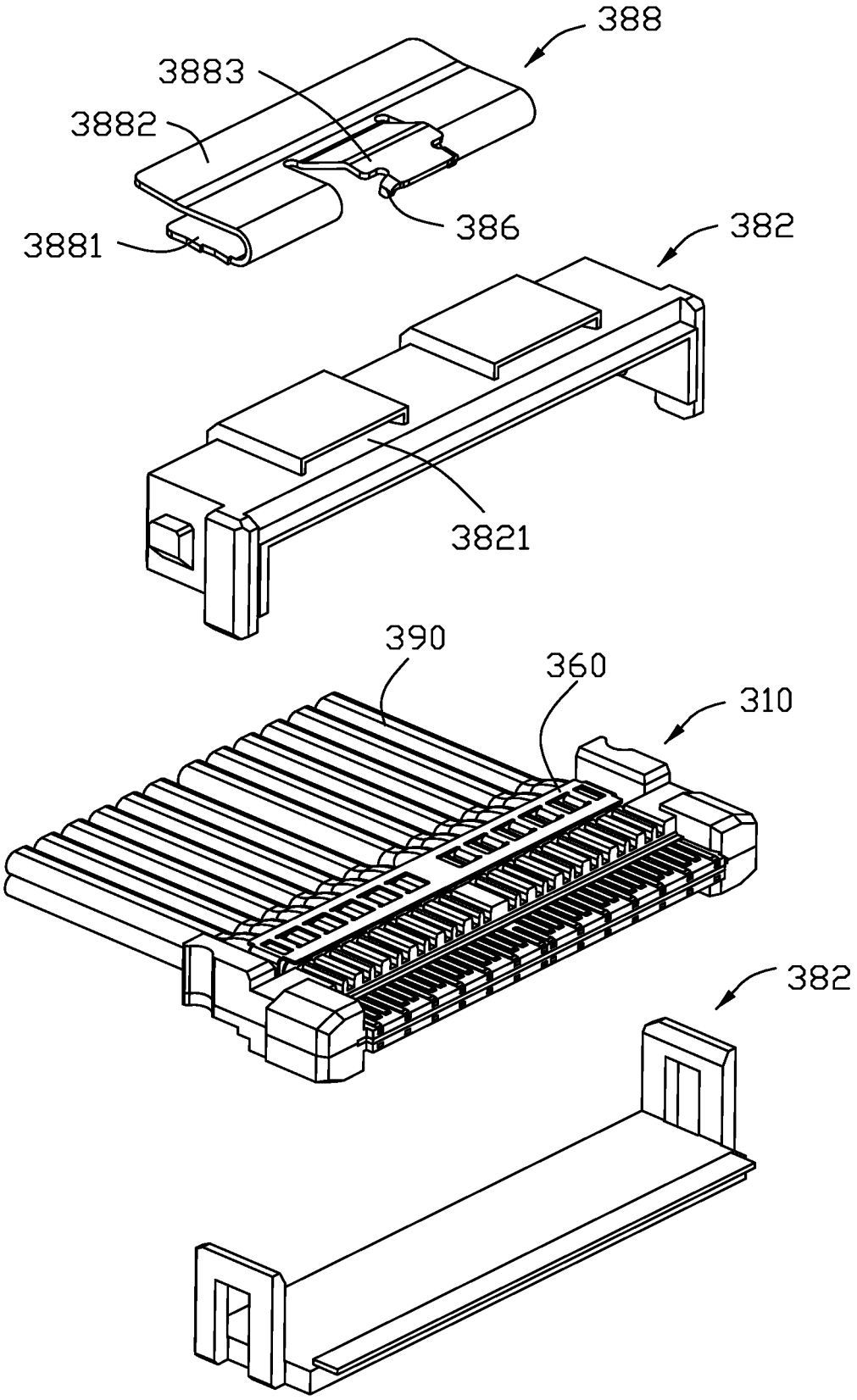
FIG. 23 is an exploded perspective view of the plug connector of the electrical connector assembly of FIG. 17.
Figure 24:
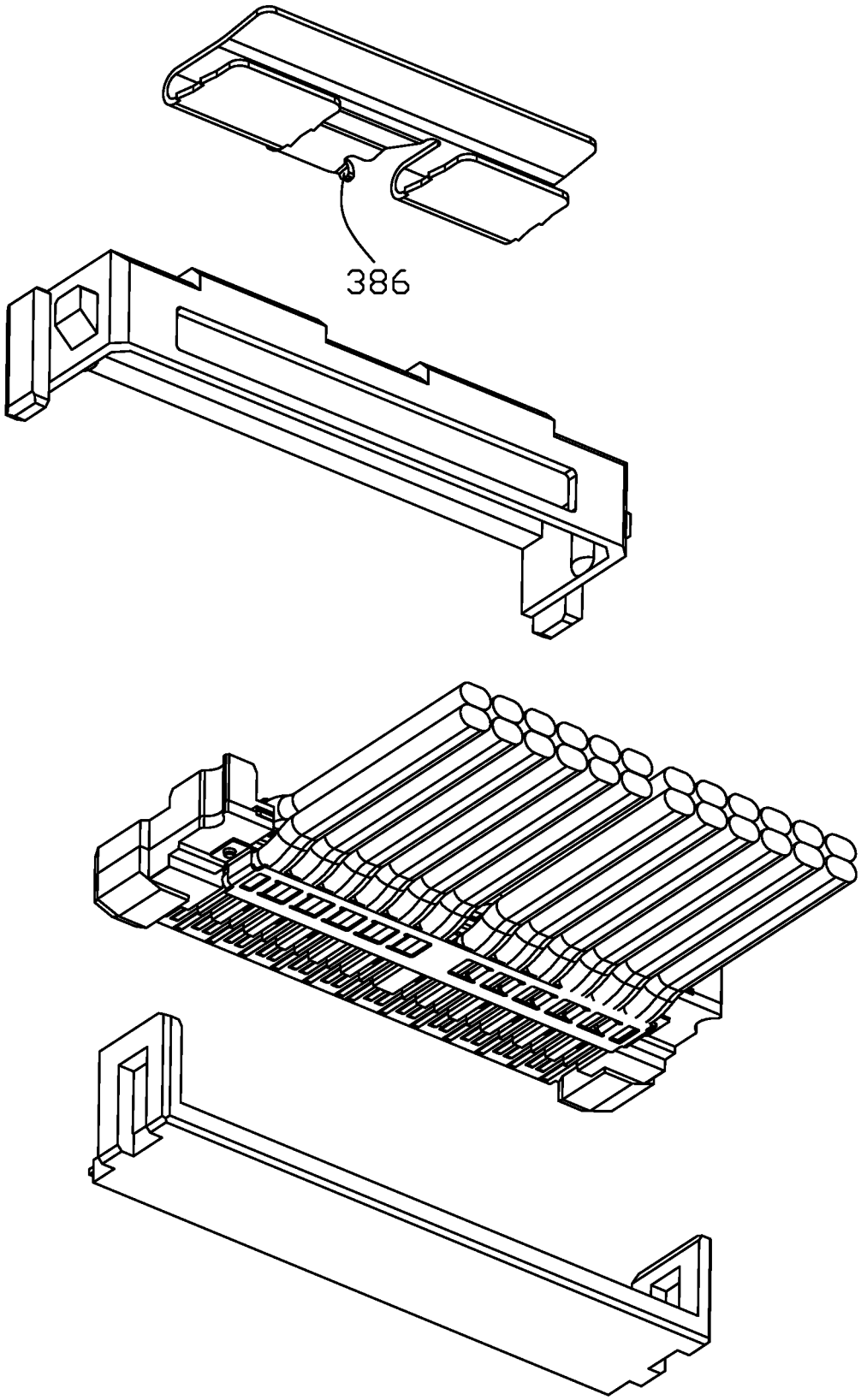
FIG. 24 is another exploded perspective view of the plug connector of the electrical connector assembly of FIG. 23.
Figure 25:
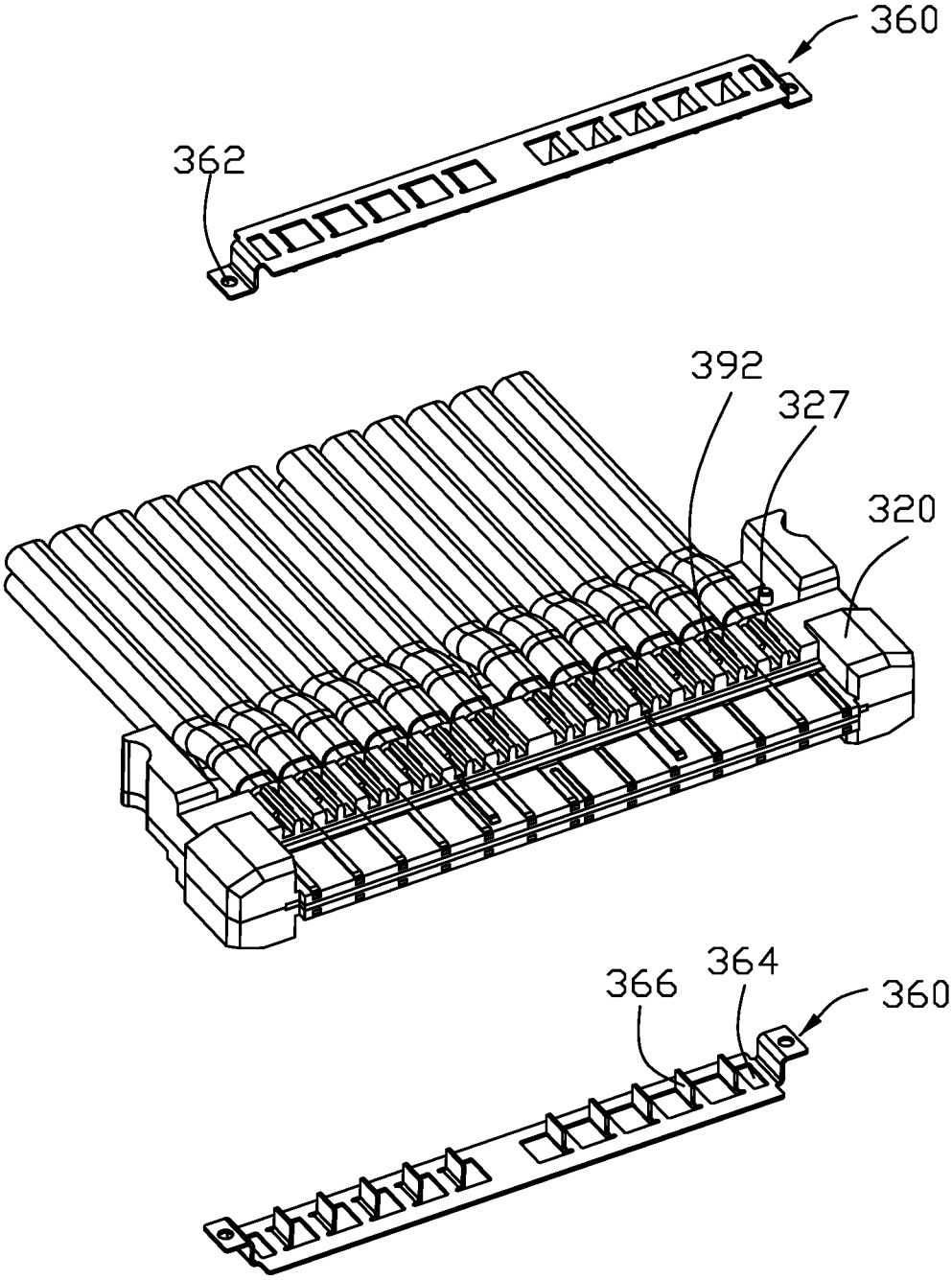
FIG. 25 is a further exploded perspective view of the plug connector of the electrical connector assembly of FIG. 23.
Figure 26:
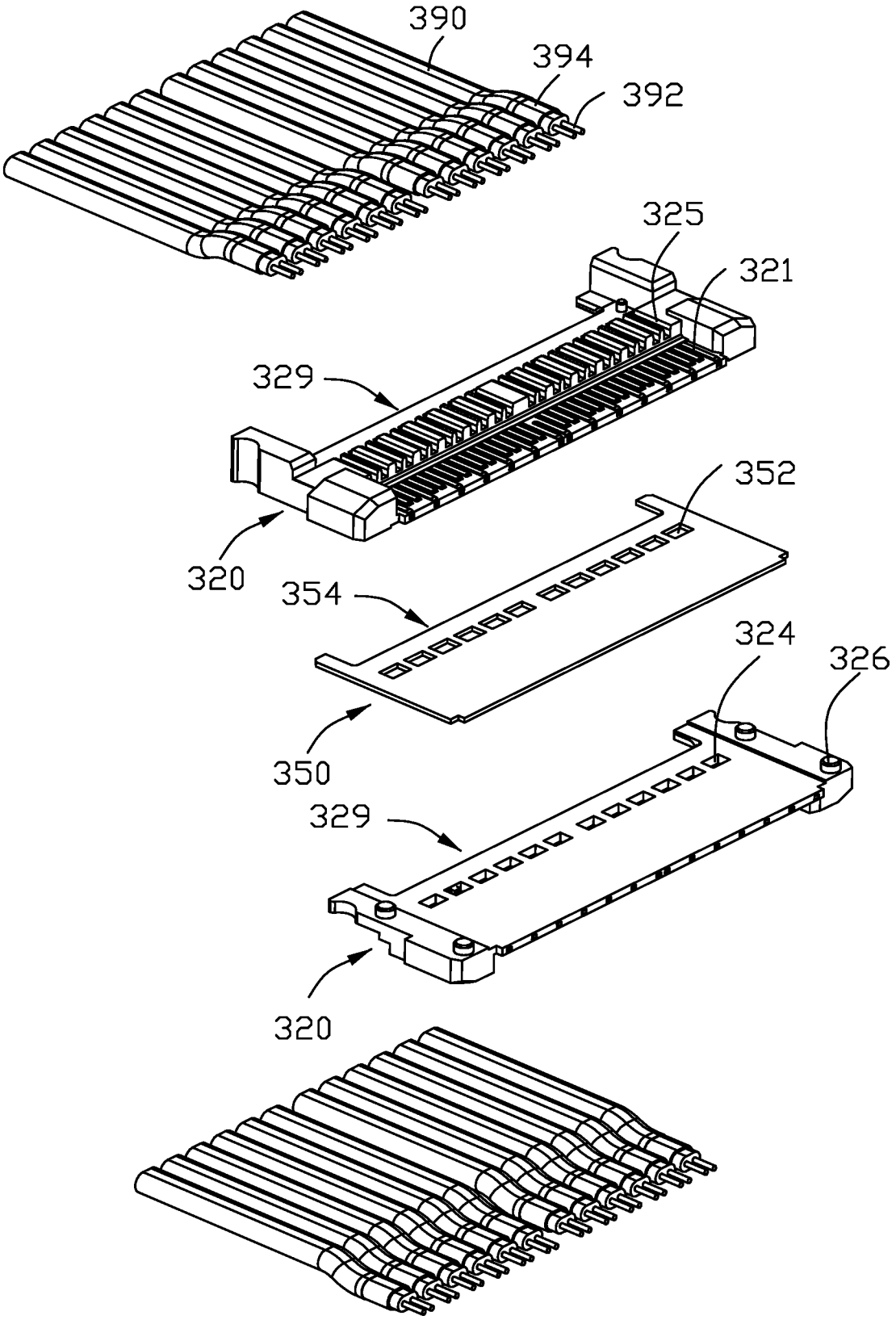
FIG. 26 is a further exploded perspective view of the plug connector of the electrical connector assembly of FIG. 25.
Figure 27:
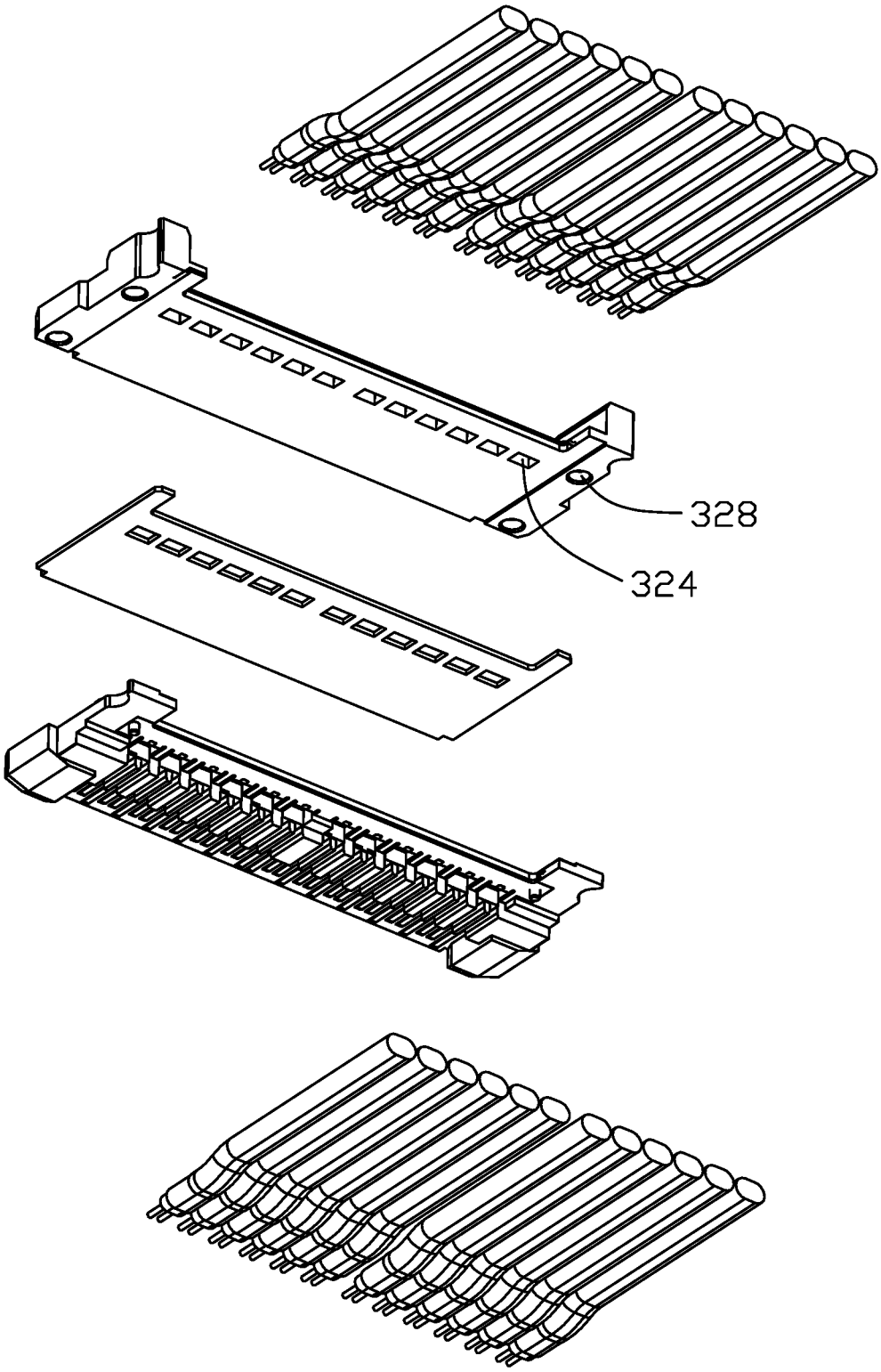
FIG. 27 is another explode perspective view of the plug connector of the electrical connector assembly of FIG. 26.

As shown in FIG. 17, the outer shell 380 fitly encloses a rear end of the plug contact module 310 and a front end of the plug contact module 310 is expose to an outer exterior which is defined as a plug mating portion 310A. The mating portions 310A is construed with the front lower regions 321 which is functioned as a front tongue 321, a pair of guiding posts 3211 and a front end of the platform 323. As shown in FIG. 22, the hooks 386 are located aligned with the front portion of the platform 323 and behind the front tongue 321.

Figure 29:
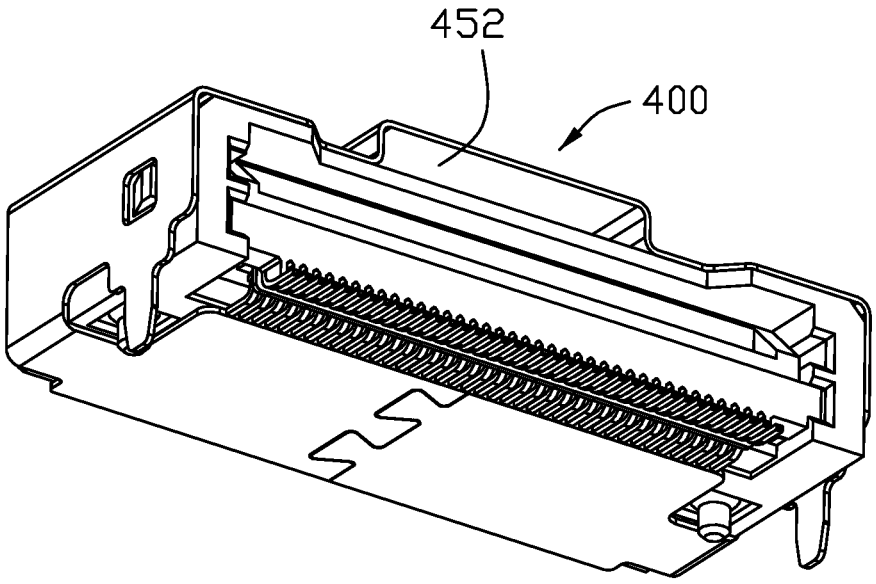
FIG. 29 is a rear perspective view of the receptacle connector of the electrical connector assembly of FIG. 18.
Figure 30:
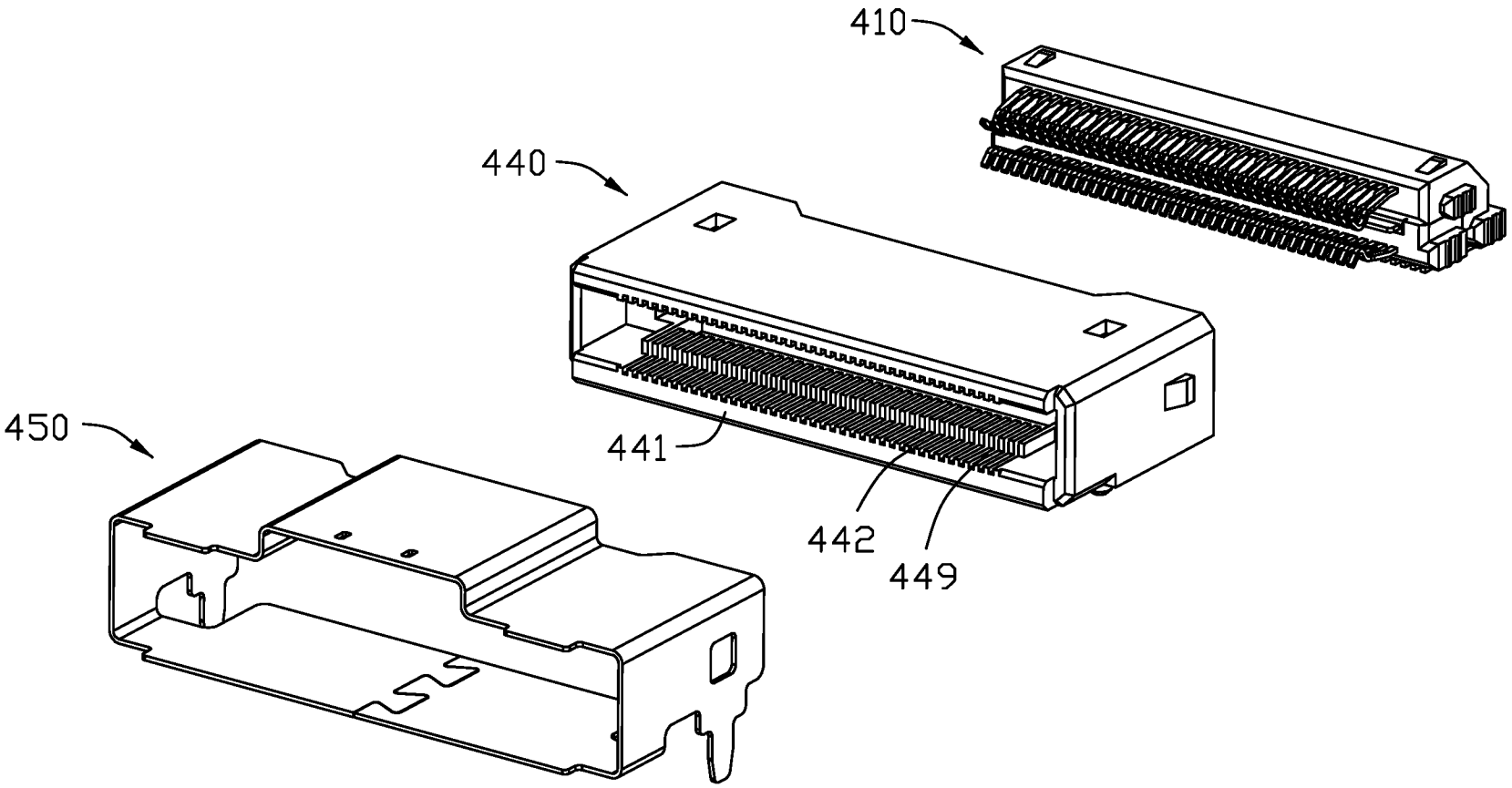
FIG. 30 is an exploded perspective view of the receptacle connector of the electrical connector assembly of FIG. 18.
Figure 31:
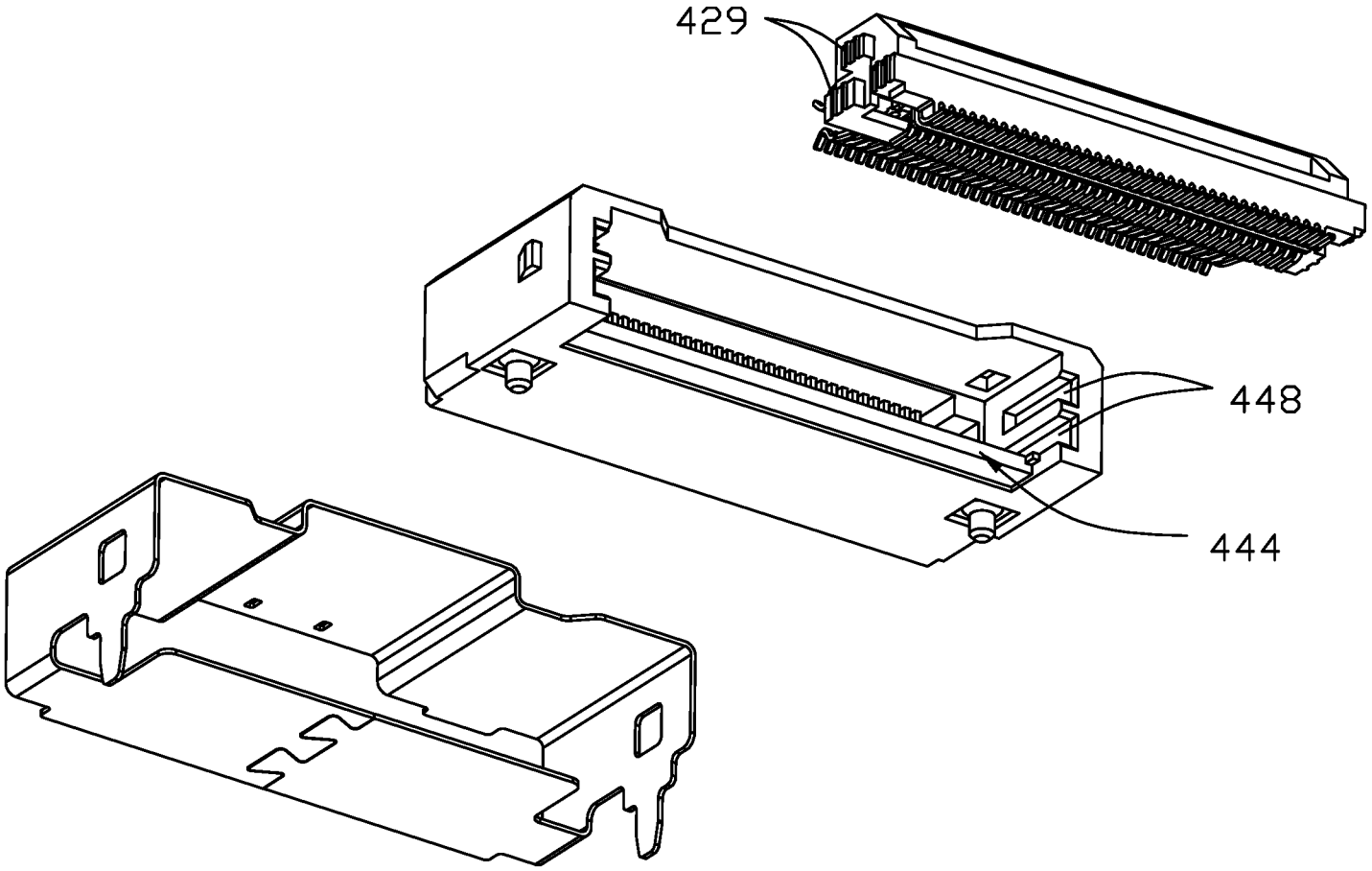
FIG. 31 is another exploded perspective view of the receptacle connector of the electrical connector assembly of FIG. 30.
Figure 32:
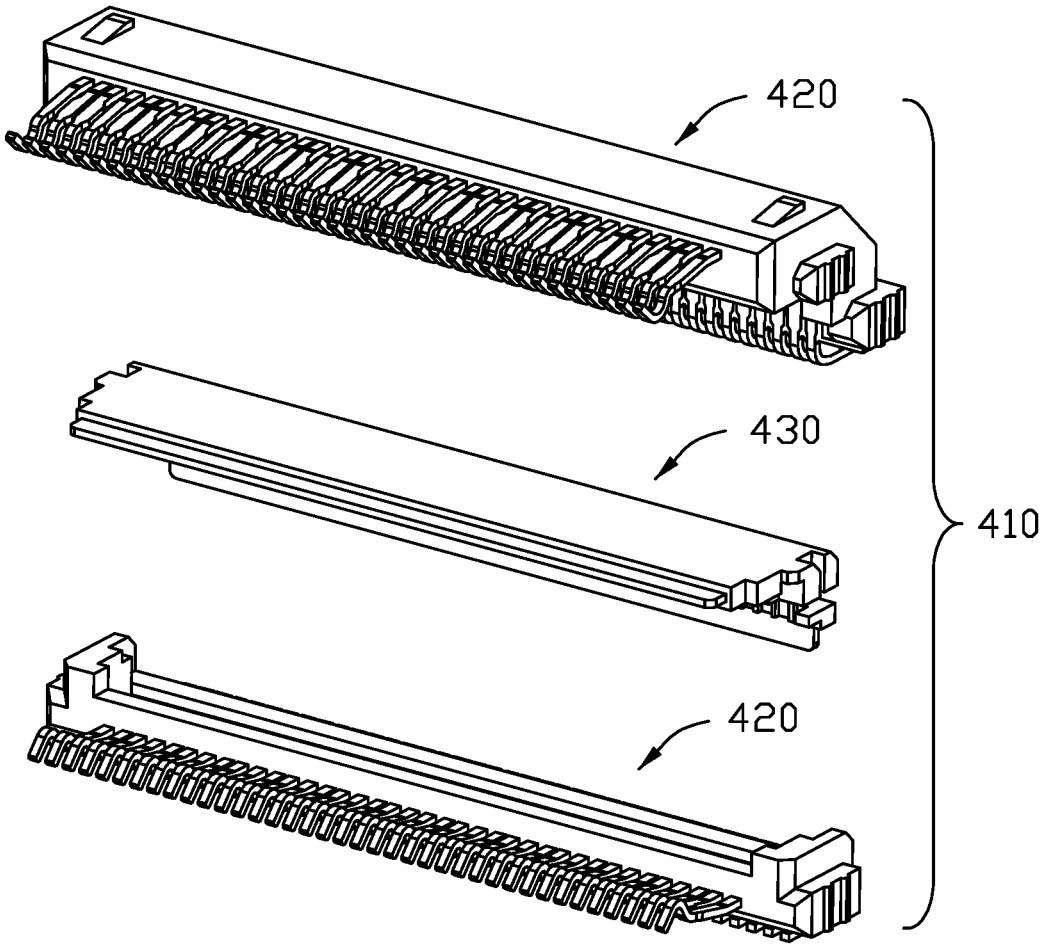
FIG. 32 is a further exploded perspective view of the receptacle connector of the electrical connector assembly of FIG. 30.
Figure 33:
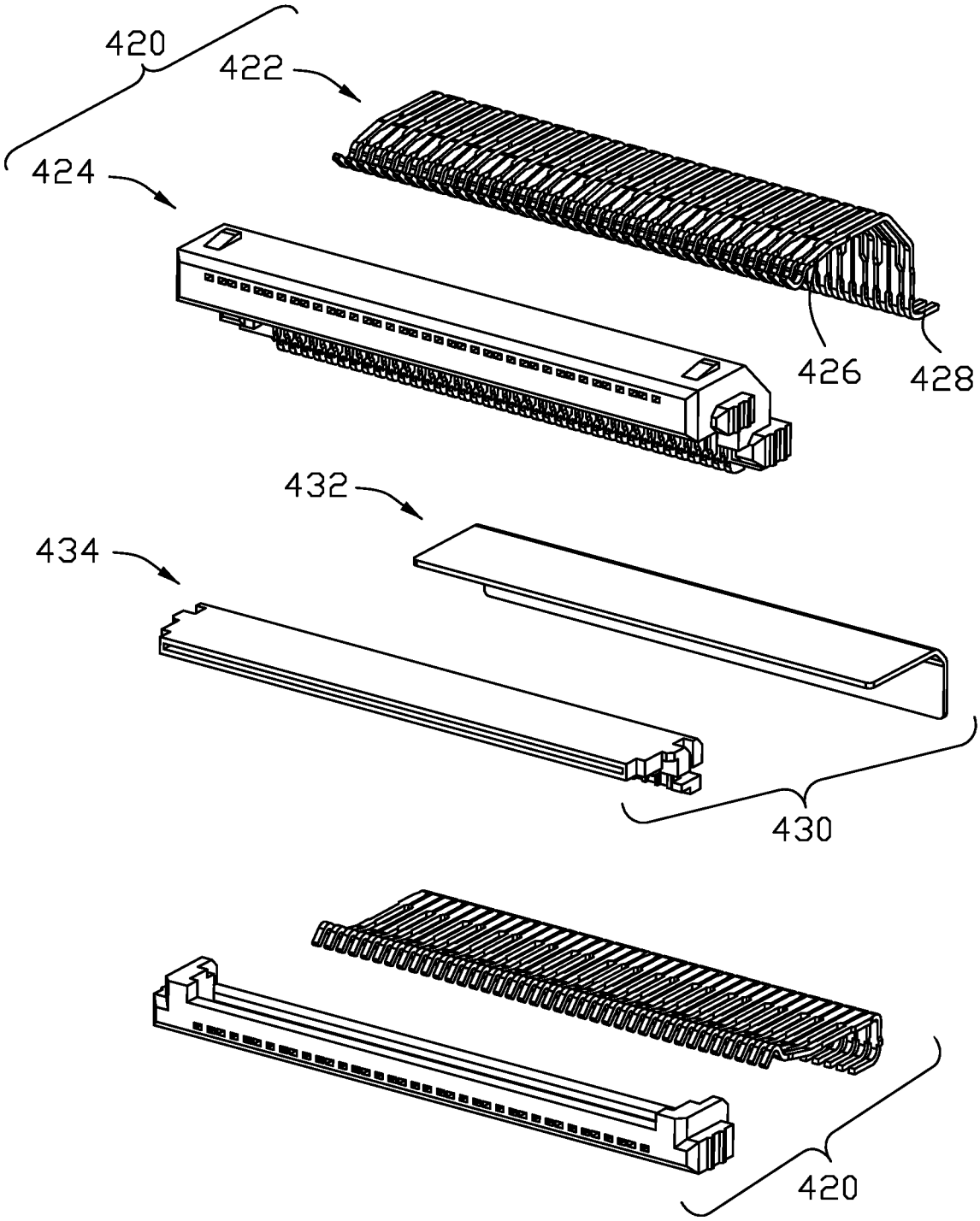
FIG. 33 is a further exploded perspective view of the receptacle connector of the electrical connector assembly of FIG. 32.
Figure 34:
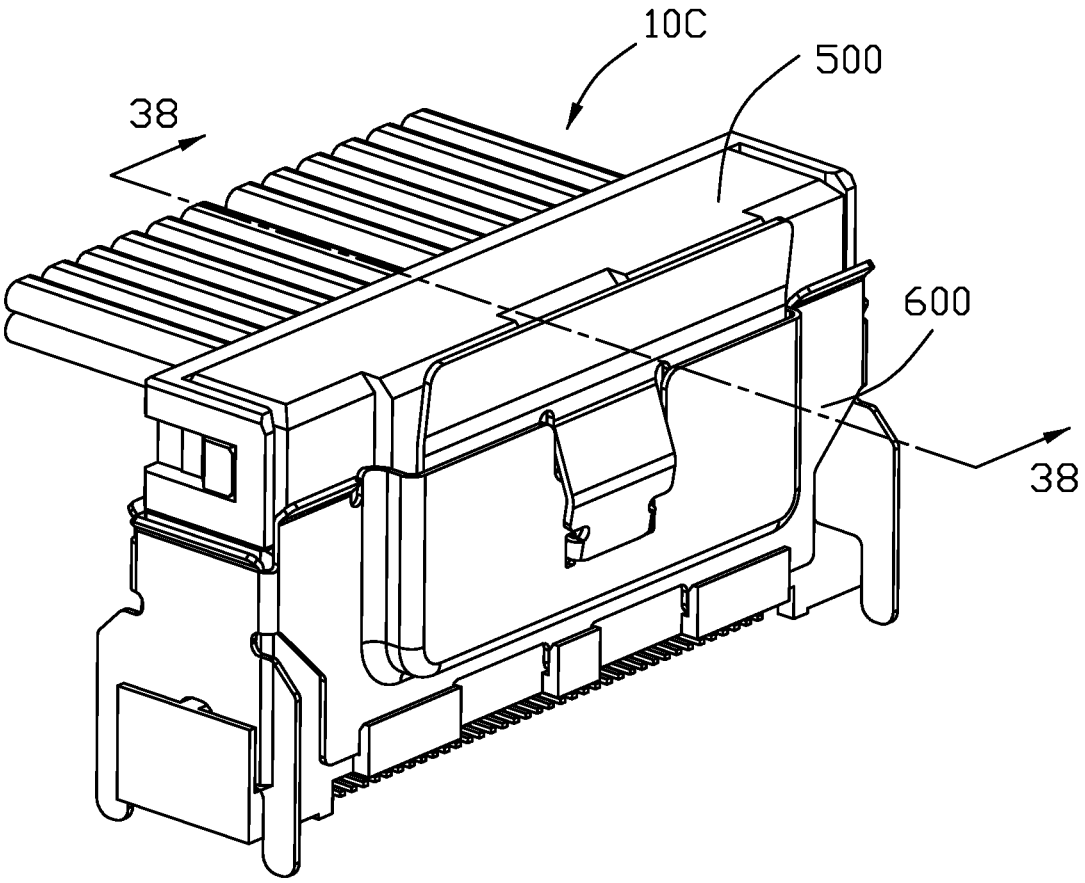
FIG. 34 is a perspective view of the electrical connector assembly according to a third embodiment of the invention.
Figure 35:
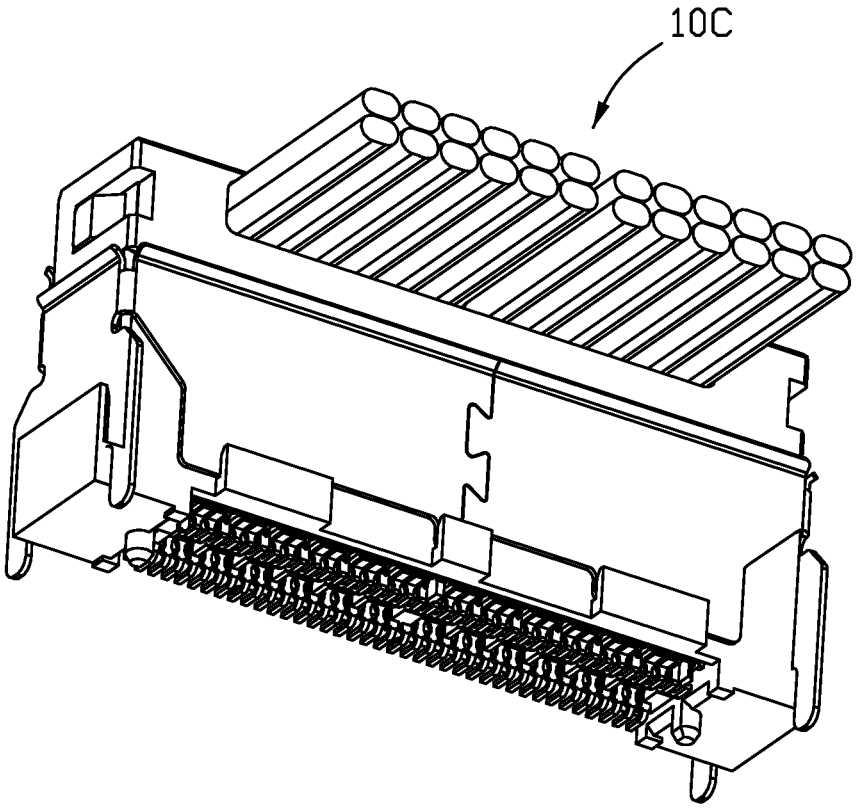
FIG. 35 is another perspective view of the electrical connector assembly according of FIG. 34.
Figure 36:
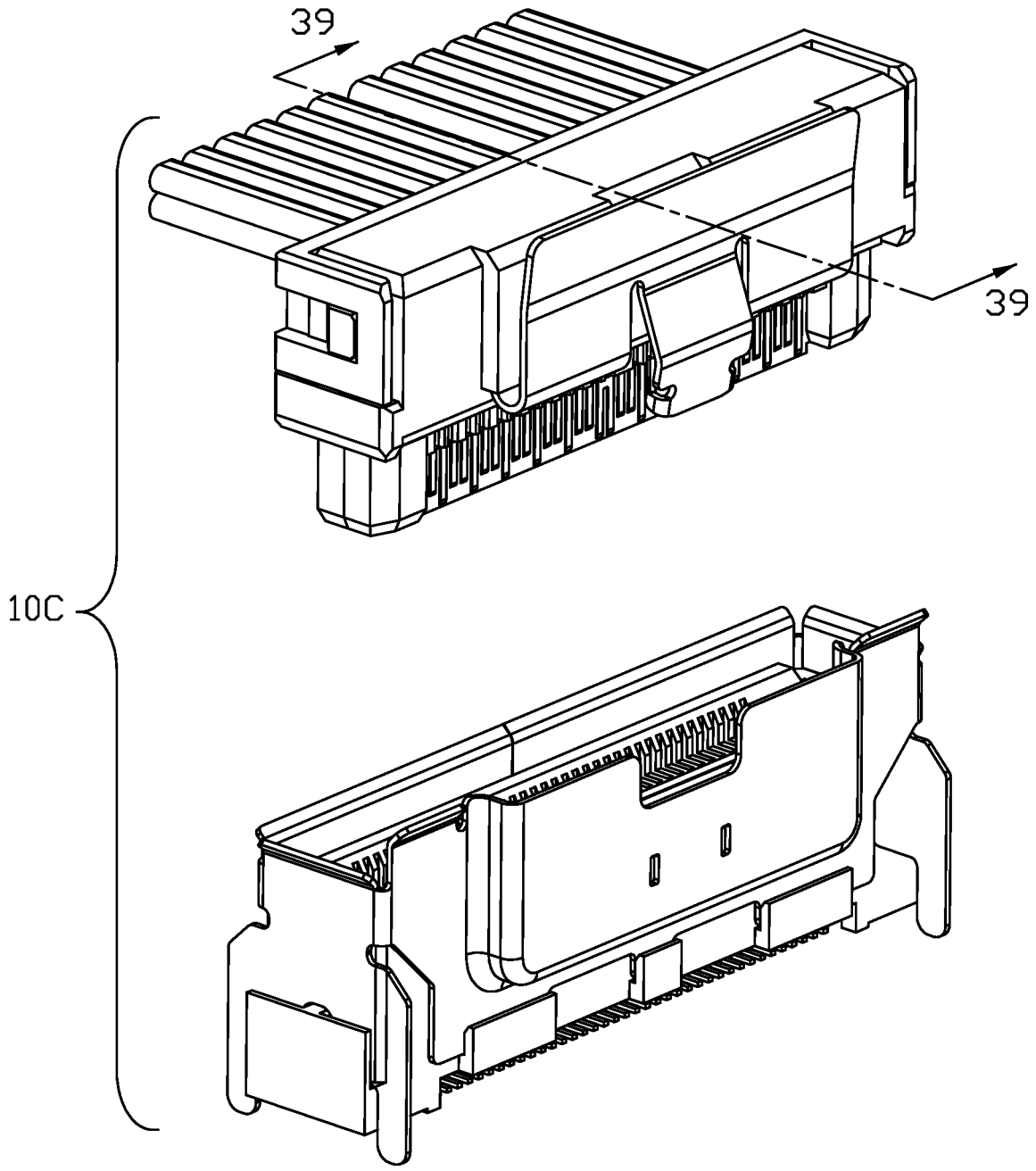
FIG. 36 is a perspective view of the electrical connector assembly of FIG. 34 wherein the plug connector and the receptacle connector are separated from each other.
Figure 37:
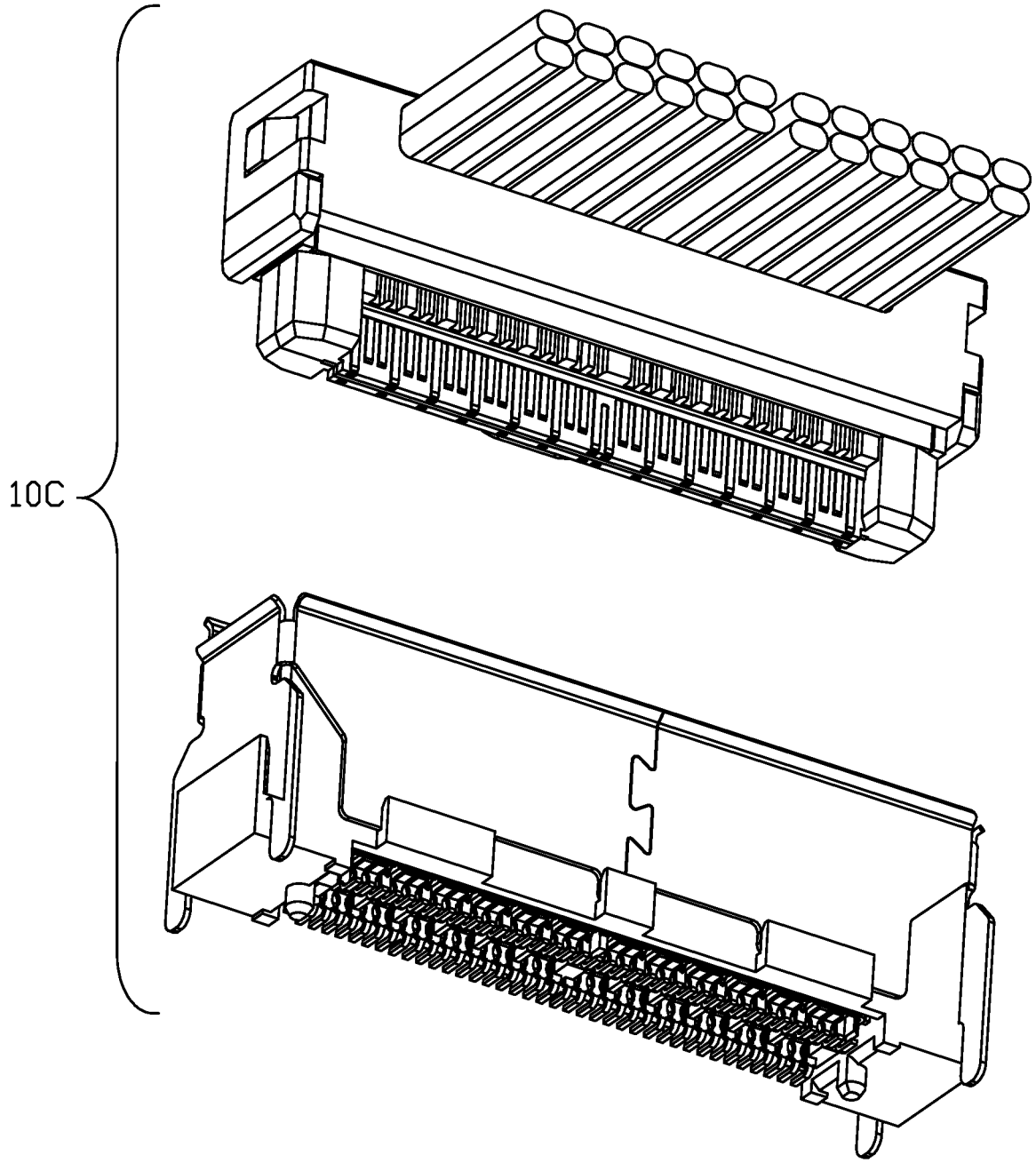
FIG. 37 is another perspective view of the electrical connector assembly of FIG. 36.
Figure 38:
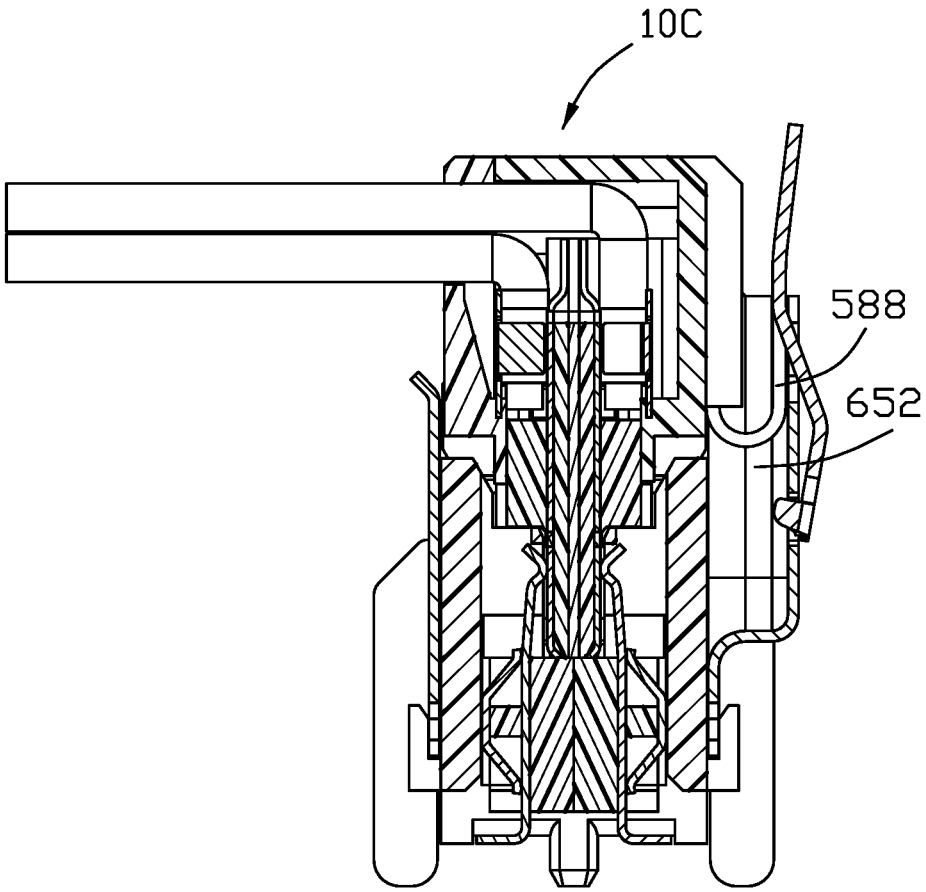
FIG. 38 is a cross-sectional view of the electrical connector assembly taken along line 38-38 in FIG. 34.
Figure 39:
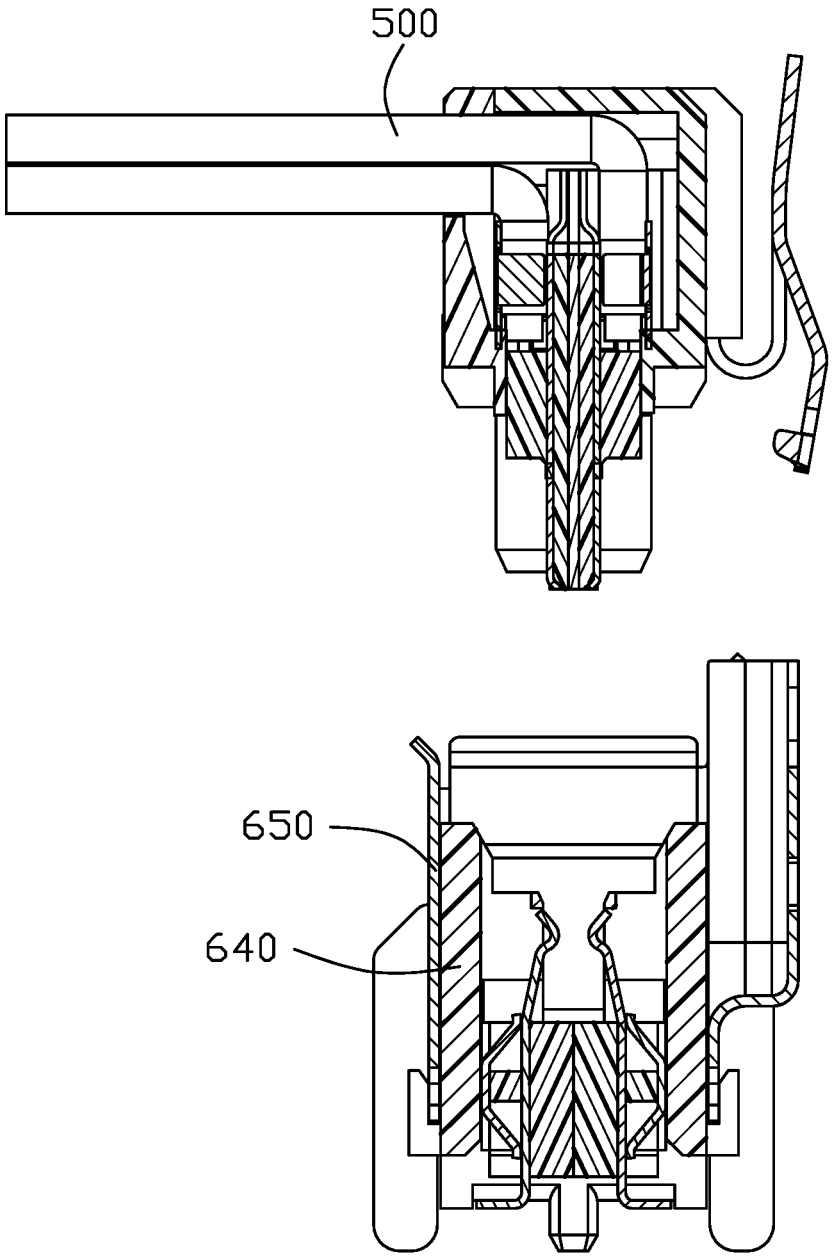
FIG. 39 is a cross-sectional view of the electrical connector assembly taken along line 39-39 in FIG. 36.
Figure 40:
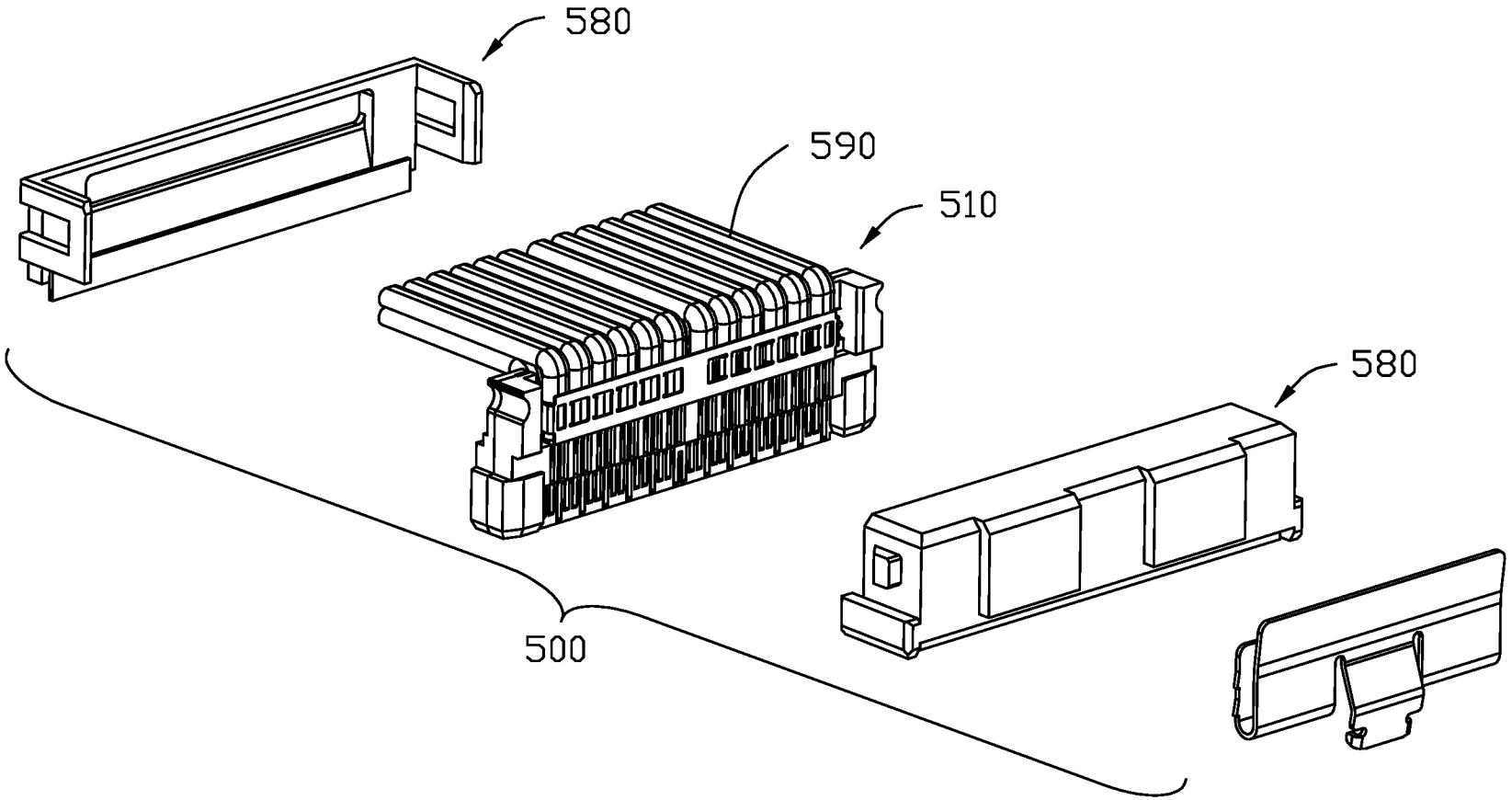
FIG. 40 is an exploded perspective view of the plug connector of the electrical connector assembly of FIG. 39
Figure 41:
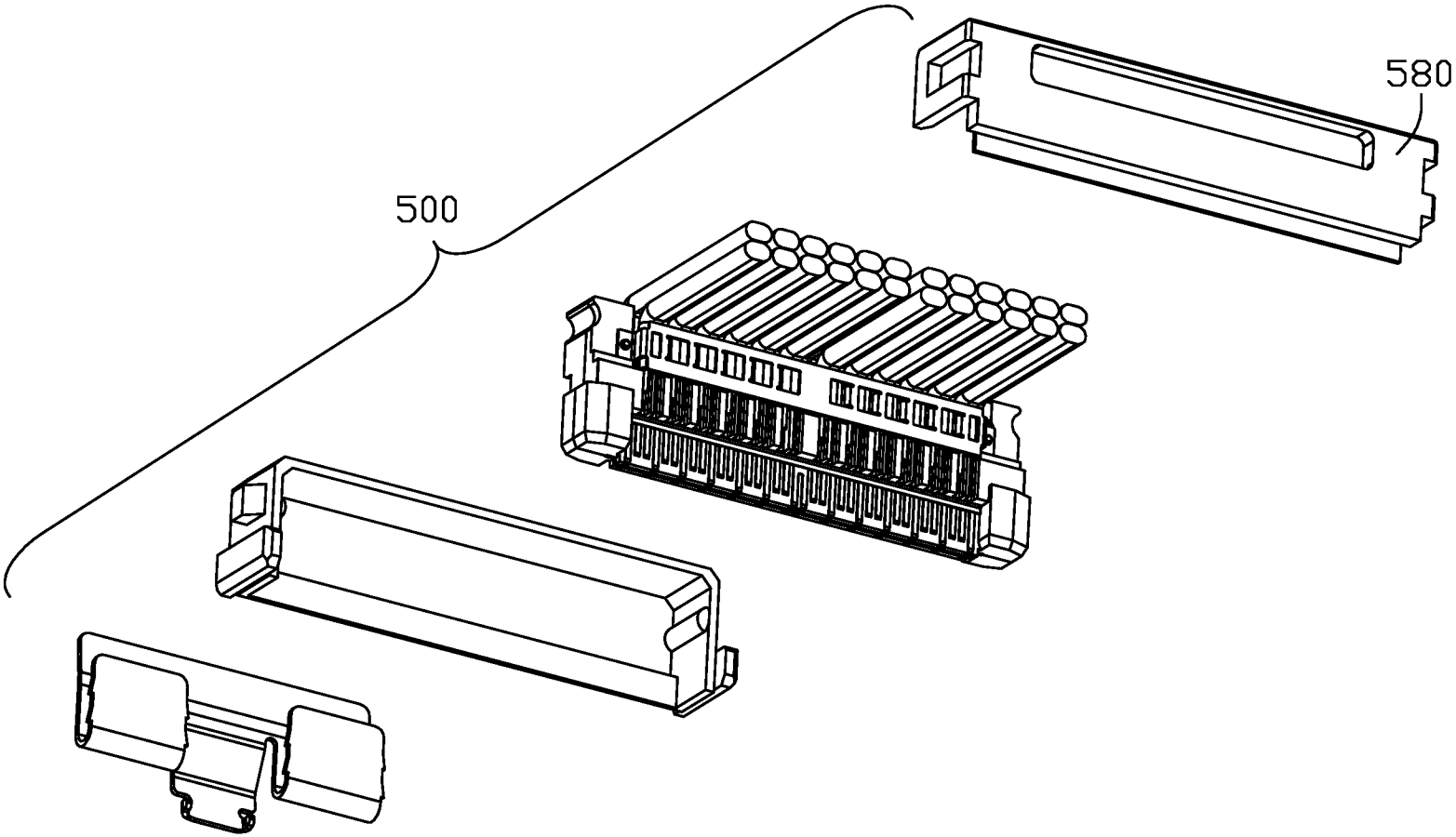
FIG. 41 is another exploded perspective view of the plug connector of the electrical connector assembly of FIG. 40.
Figure 42:
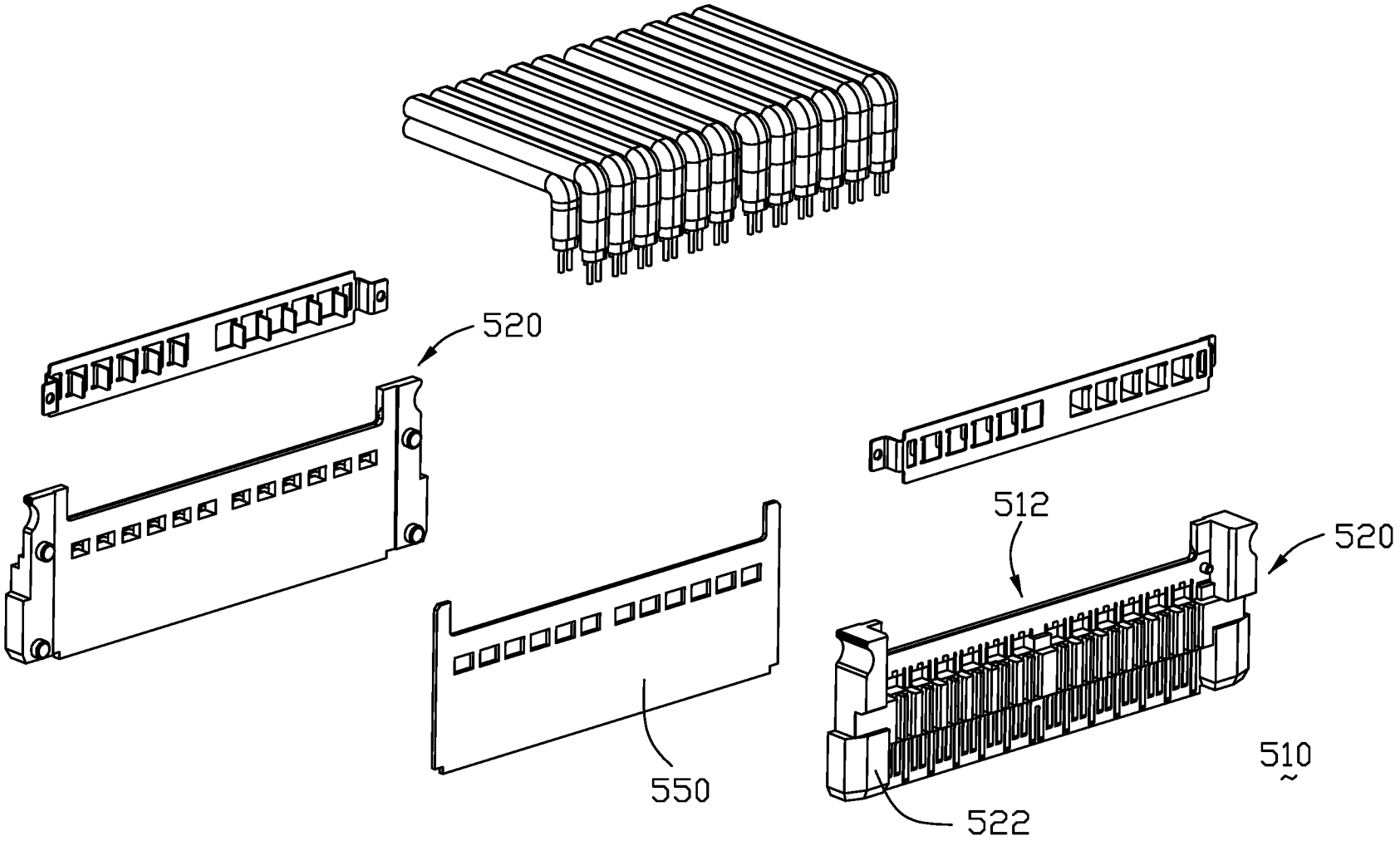
FIG. 42 is a further exploded perspective view of the plug connector of the electrical connector assembly of FIG. 40.
Figure 43:
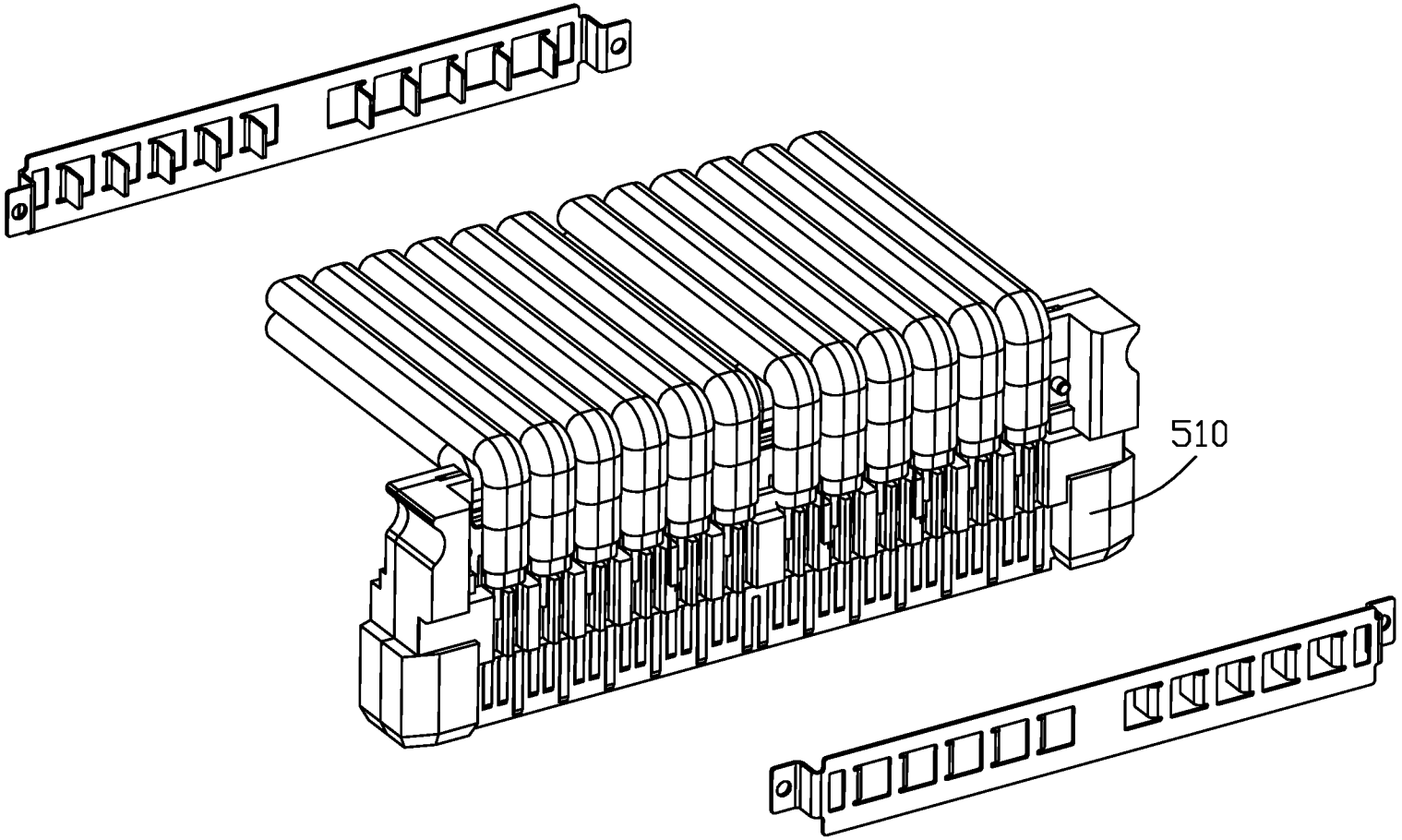
FIG. 43 is a perspective view of the plug connector of the electrical connector assembly of FIG. 40 without the outer shell and the latch.

Further referring to FIGS. 29-33, the receptacle connector 400 for mating with the plug connector 300, includes a receptacle contacts module 410 enclosed within an insulative housing 440 which is further enclosed within a metallic shield 450. The receptacle contact module 410 includes a pair of receptacle contact units 420 commonly sandwiching a shielding plate unit 430. Each receptacle contact unit 420 includes a plurality of receptacle contacts 422 integrally formed within an insulator 424 via insert-molding. Each insulator 424 includes two guiding projections 429 to be received within the guiding channels 448 in the housing 440. The shielding plate unit 430 includes a metallic shielding plate 432 integrally formed within another insulator 434 via insert-molding. Each contact 422 includes a front contacting section 426 extending into a mating slot 442 of the housing 440, and a rear soldering section/tail 428 extending outside of the housing 440. The soldering section/tail 428 of the receptacle contact 422 in the lower row is received within a recess 444 labeled in FIG. 31, of the housing 240. The insulative housing 440 forms a plurality of passageways 449 beside the mating slot 442 on the longitudinal walls 441 to receive the contacting sections 426 of the corresponding receptacle contacts 422. Understandably, the contacts 422 include the differential pairs and the grounding contacts corresponding to the plug contacts 430. A locking space 452 as best shown in FIG. 29, is formed between the metallic shield 450 and the housing 440 to receive the latch 388 during mating with the plug connector 300. The metallic shield 450 forms a pair of locking holes 454 to receive the corresponding hook 386.

As best shown in FIGS. 29-33, the housing 440 defines two guiding hole 442B at opposite longitudinal ends of the slot 442A in the longitudinal direction, each guiding hole 442B has a larger dimension in the lateral direction than the slot 442A between the longitudinal walls 441, the passageways 449 are only defined on the longitudinal walls 441 besides the slot 442A, not defined on the longitudinal wall beside the slot 442A. Each longitudinal walls 441 further defines cavity 442C communicating with the slot 442A and the guiding holes 442B, commonly defining said mating slot 442. The contacting sections 426 extend into the slot 422A. The cavity 442C is located between the mating face 4410 of the housing and contacting sections 426. The guiding posts 3211 are inserted in the guiding holes 442B, the front tongue 321 in the slot 442A, the front portion of the platform 423 in the cavity 442C to retain the plug connector 300 in the receptacle connector 400. The resilient latch 388 does not extend into the locking space 452 except that the hooks 386 protrude into the locking holes 454.

Figure 44:
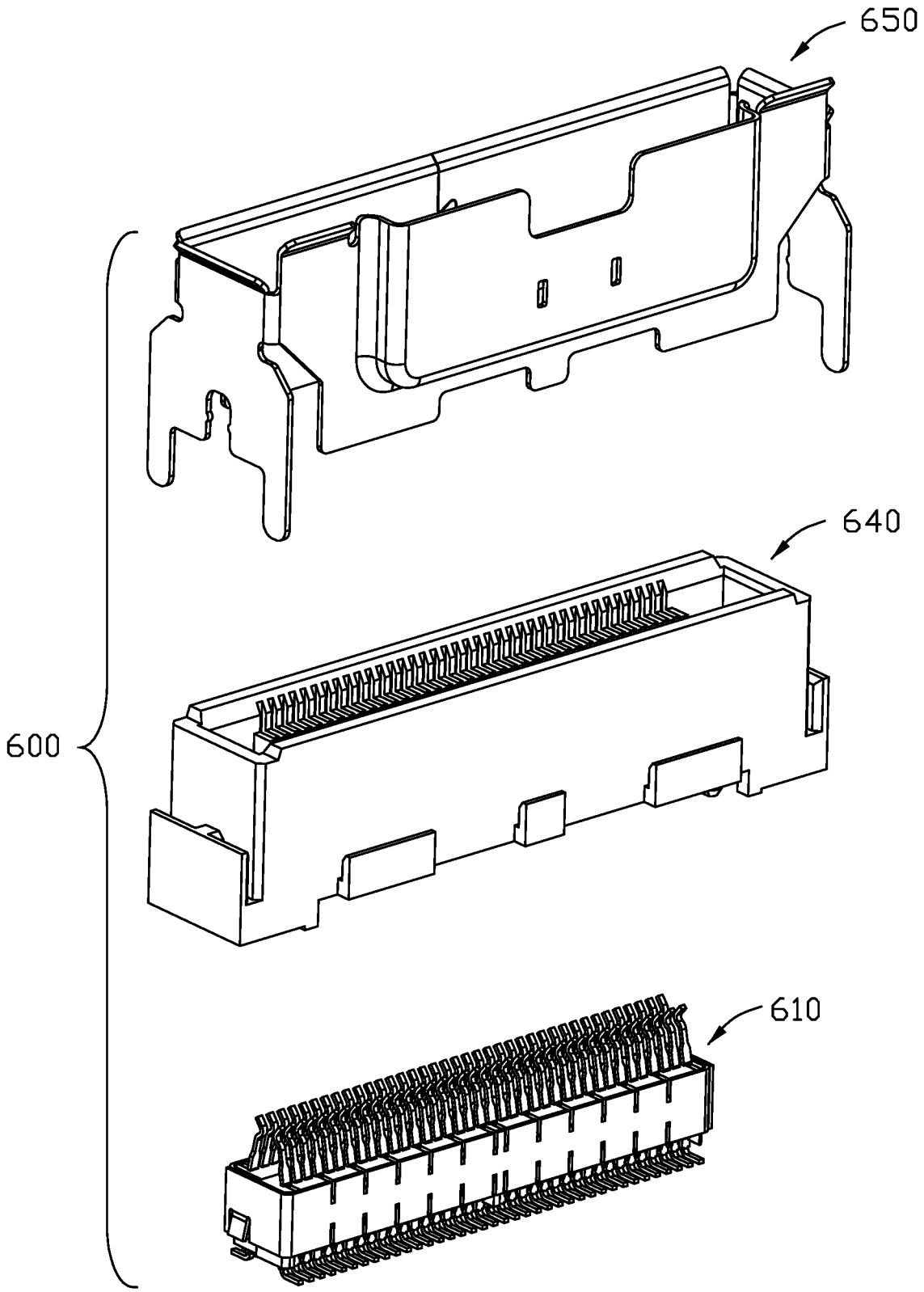
FIG. 44 is a perspective view of the receptacle connector of the electrical connector assembly of FIG. 36.
Figure 45:
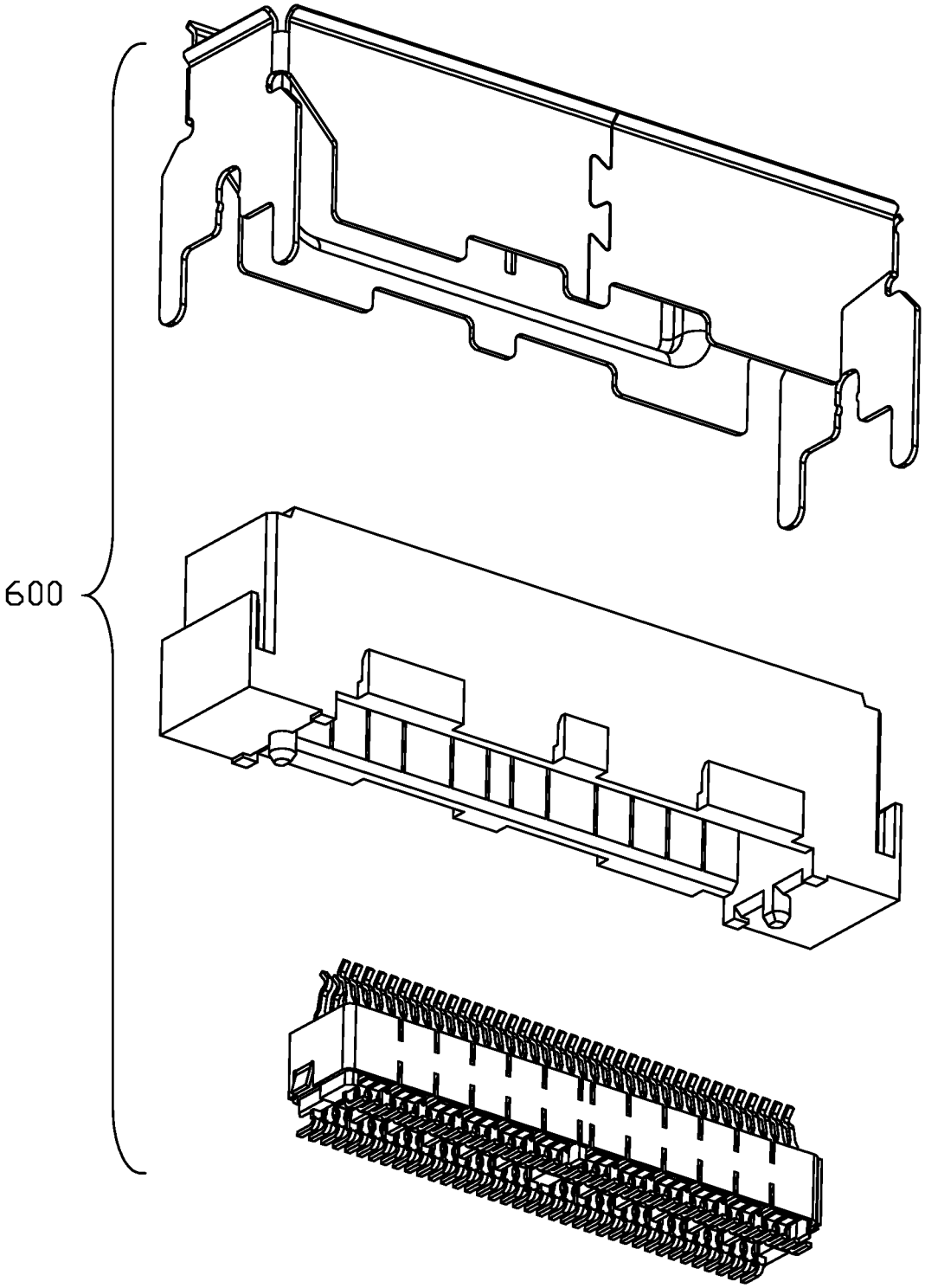
FIG. 45 is another perspective view of the receptacle connector of the electrical connector assembly of FIG. 44.
Figure 46:
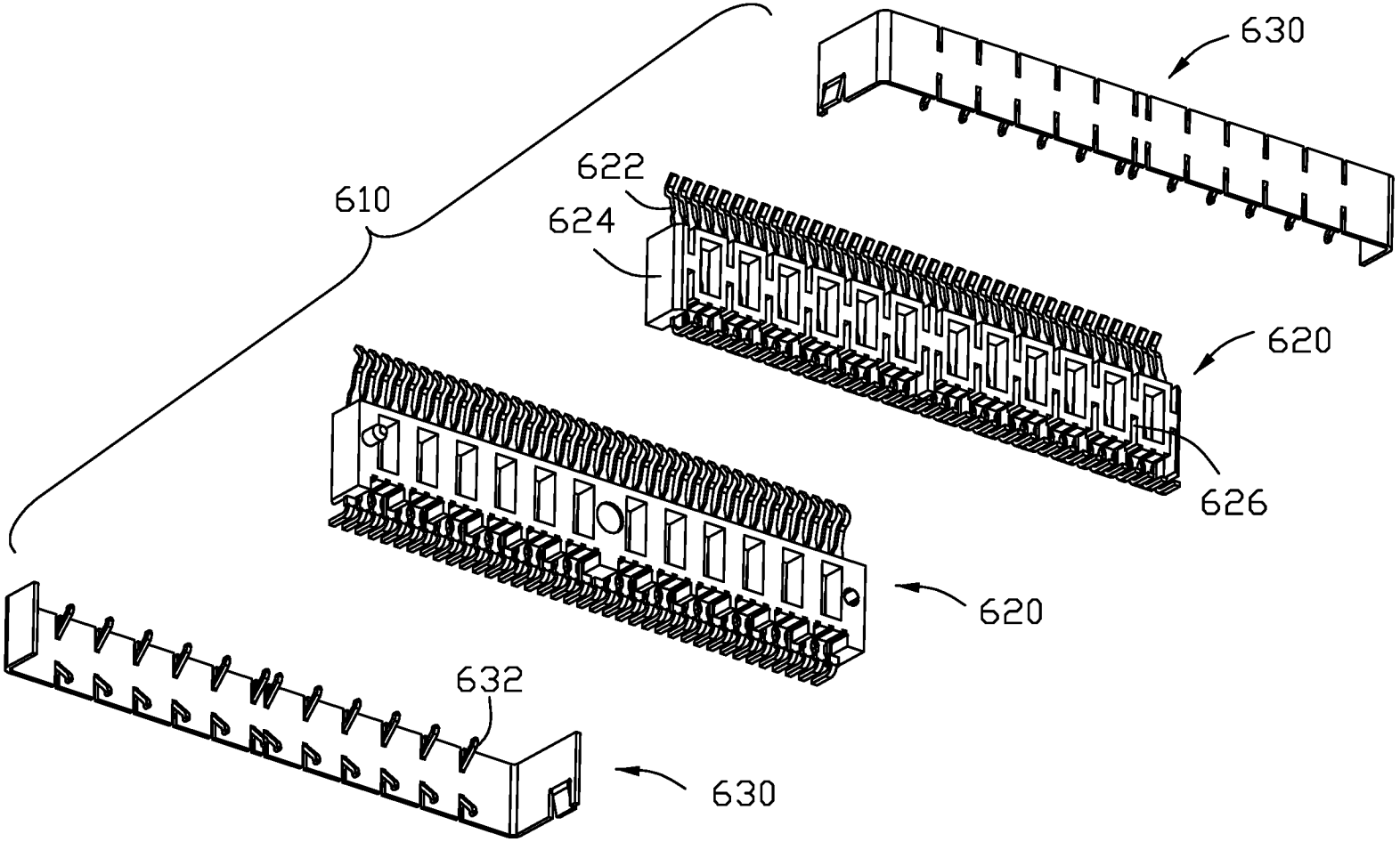
FIG. 46 is an exploded perspective view of the receptacle contact module of the receptacle connector of the electrical connector assembly of FIG. 45.

Referring to FIGS. 34-46 illustrated a third embodiment, an electrical connector assembly 10C includes a plug connector 500 and a receptacle connector 600 mateable with each other in a vertical direction, compared with those in the second embodiment mateable along a horizontal direction. The plug connector 500 includes a plug contact module 510 enclosed within an outer shell 580 and connected with a plurality of wires 590. The plug contact module 510 includes a pair of a plug contact units 520 commonly sandwiching a metallic shielding plate 550 therebetween. Each plug contact unit 520 includes a plurality of plug contacts 530 integrally formed within an insulator 522. The structure of the plug contact module 510 is similar to that of the plug contact module 310 disclosed in the second embodiment. The main difference between the plug connector 500 in this embodiment and the plug connector 310 in the second embodiment, is that the wires 590 extend through the rear space 512 of the plug contact module 510 in a direction perpendicular to the mating direction, in comparison with the wires 590 extending in a direction parallel to the mating direction as shown in the first embodiment Further referring to FIGS. 44-46, a receptacle connector 600 for mating with the plug connector 500, includes a receptacle contact module 610 enclosed within an insulative housing 640 which is further enclosed within a metallic shield or an outer shell 650. The receptacle contact module 610 includes a pair of receptacle contact units 620 and commonly sandwiched between a pair of grounding bars or plates 630. Each receptacle contact unit 620 includes a plurality of receptacle contacts 622 integrally formed within an insulator 624. The receptacle contacts 622 include a plurality of differential pairs and grounding contacts alternately arranged with each other in a transverse direction. The insulator 624 forms a plurality of grooves 626 in alignment with the corresponding grounding contacts so as to allow the spring fingers 632 to extend therethrough for contacting the corresponding grounding contacts. Notably, the main difference between the receptacle connector 600 and the receptacle connector 400 is that the receptacle connector 400 is of a horizontal type while the receptacle connector 600 is a vertical type. The secondary difference is that the receptacle contact module 410 has a shielding plate unit 430 sandwiched between the pair of receptacle contact units 420 in the receptacle connector 400 while the receptacle contact module 610 has no shielding plate unit between the pair of receptacle contact units 620 but with a pair of grounding bars 630 upon exterior surfaces of said pair of receptacle contact units 620. The third difference is that the out shell 650 extends upwards beyond the mating face of the insulative housing 640, forming a guiding edge. The latch 588 is partly inserted in the receiving space 652 defined on the receptacle connector.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A plug connector adapted for connecting corresponding wires, comprising:

an insulative body;

at least one row of plug contacts being categorized with differential-pair contacts and grounding contacts alternately arranged with each other in a longitudinal direction; and a transverse bar extending along the longitudinal direction and unitarily linked to rear ends of all the grounding contacts of each row of plug contacts while being isolated from the differential-pair contacts;

wherein the at least one row of plug contacts and the transverse bar are stamped from a same sheet metal initially, and the differential-pair contacts are successively disconnected from the transverse bar after the plug contacts are integrally formed with the insulative body.

2. The plug connector as claimed in claim 1, wherein the insulative body comprises a plurality of through openings to expose, in a lateral direction perpendicular to the longitudinal direction, linking sections of the differential-pair contacts which are joined with the transverse bar so as to remove the linking sections via the through openings for separating the differential-pair contacts from the transverse bar.

3. The plug connector as claimed in claim 2, wherein the differential-pair contacts have corresponding tail sections for connecting to inner conductors of the corresponding wires, the linking sections are originally connected between the transverse bar and the corresponding tail sections of the differential-pair contacts in a vertical direction perpendicular the longitudinal direction.

4. The plug connector as claimed in claim 3, wherein the tail sections of the differential-pair contacts are outwardly offset from corresponding contacting sections of the contacts in a lateral direction.

5. The plug connector as claimed in claim 3, wherein the transverse bar includes a front part and a rear part, and the grounding contacts unitarily extend from the front part, and the front part is mechanically and electrically connected to metallic braiding layers of the corresponding wires.

6. The plug connector as claimed in claim 1, wherein there are two rows of plug contacts arranged in a lateral direction and a shielding plate between the two rows of plug contacts, the shielding plate mechanically and electrically connecting to the rear part of the transverse bar.

7. The plug connector as claimed in claim 1, further comprising a grounding bar attached upon the insulative body and located outside of the plug contacts in a lateral direction, and the grounding bar forms a plurality of openings in alignment with the corresponding plug contacts, respectively, in the lateral direction to apply soldering material to an exposed portion of the wire and the transverse bar.

8. The plug connector as claimed in claim 1, wherein the insulative body defines a front tongue, a platform with a plurality of grooves and behind the front tongue in a mating direction, and a pair guiding posts at opposite ends of the front tongue in the longitudinal direction, the plug contacts comprises contacting section exposed upon the front tongue and tail sections received in grooves, and the front tongue, a pair of guiding posts and a front portion of the platform commonly define a mating portion of the plug connector.

9. The plug connector as claimed in claim 1, wherein the insulative body is enclosed within an outer shell and the outer shell is equipped with a latch, and a hook of the latch is located in alignment with the front portion of the platform in a vertical direction while behind the front tongue.

10. The plug connector as claimed in claim 9, wherein the insulative body is enclosed within an outer shell and the outer shell is equipped with a latch, and the latch comprises a retaining portion retained in the insulative body, a connecting portion extending from a front edge of the retaining portion and bend rearwards, and a resilient portion, the resilient portion splitting from the connecting portion and extending from a front edge of the connecting portion and extending slantwise and forwards with two hooks.

11. A plug connector adapted to be mated with a receptacle connector along a mating direction, comprising:

a plug contact module having a pair of plug contact units commonly sandwiching a metallic shielding plate therebetween, each of the plug contact units having a plurality of plug contacts integrally formed within an insulator via insert-molding, the contacts including differential pairs and grounding contacts alternately arranged with each other in a transverse direction, each contact having a front contacting section and a rear soldering section, all the grounding contacts being unified together via a transverse bar behind the corresponding soldering sections;

two sets of wires located behind the plug contact module, each wire having a pair of inner conductors mechanically and electrically connected to the soldering sections of the corresponding differential pair, and an outer copper shield positioned upon the transverse bar in a direction perpendicular to the mating direction; and a pair of grounding bars each attached upon the insulator of the corresponding plug contact unit to cooperate with the transverse bar for sandwiching the corresponding wires therebetween in said direction perpendicular to the mating direction; wherein each grounding bar forms a plurality of openings in alignment with the corresponding wires, respectively, in the direction to apply soldering material to an exposed copper shield for securing the copper shield to the transverse bar.

12. The plug connector as claimed in claim 11, wherein each insulator forms a plurality of openings for separating the differential pairs from the transverse bar after the plug contact unit is formed by insert-molding.

13. The plug connector as claimed in claim 11, wherein the outer shell is equipped with a deflectable latch.

14. A receptacle connector for mounting to a printed circuit board comprising:

a housing comprising a pair of longitudinal walls extending along a longitudinal direction and a pair of short wall connecting with the longitudinal wall, and equipped with corresponding passageways in the longitudinal wall, and defining a mating slot formed between the pair of longitudinal walls in the lateral direction;

two rows of receptacle contacts extending into both the respective passageways and the mating slot;

wherein the mating slot includes a slot between a portion of the longitudinal walls having the passageways, two guiding holes at opposite ends of the slot in the longitudinal direction between a portion of the longitudinal walls having no passageways thereon, and a cavity recessed from the mating surface of each longitudinal wall and communicating with guiding holes and the slot.

15. The receptacle connector as claimed in claim 14, wherein the longitudinal wall defines a step surface parallel to the mating surface, the step surface is located between the mating surface and the contact sections of the receptacle contacts along a mating direction.

16. The receptacle connector as claimed in claim 14, wherein the housing defines a receiving space opposite to the mating slot, and a contact module is received within the receiving space, the contact module includes a pair of insulators stacked with each other in a lateral direction, the receptacle contacts are integrally formed within the corresponding insulators.

17. The receptacle connector as claimed in claim 16, wherein the contact module is enclosed within an inner metallic shell, and the housing is enclosed within an outer metallic shell.

18. The receptacle connector as claimed in claim 14, further comprising a contact module enclosed within the housing, and wherein the housing is enclosed within an outer metallic shell with a locking space therebetween for receiving a deflectable latch of a plug connector during mating.

19. The receptacle connector as claimed in claim 18, wherein the contact module includes a pair of receptacle contact units commonly sandwiching a shielding plate unit therebetween.

20. The receptacle connector as claimed in claim 18, wherein the contact module includes a pair of receptacle contact units commonly sandwiched between a pair of grounding plates, a plurality of grooves are formed in the insulator, and the grounding plate forms a plurality of spring fingers extending into the corresponding grooves to mechanically and electrically connect corresponding receptacle grounding contacts.

* * * * *